US011759669B2

(12) United States Patent
Lisi et al.

(10) Patent No.: US 11,759,669 B2
(45) Date of Patent: Sep. 19, 2023

(54) BARBELL WEIGHT RETAINING MECHANISM AND METHOD OF USE

(71) Applicant: L&S Prestige LLC, Franklin Square, NY (US)

(72) Inventors: Michael Lisi, Franklin Square, NY (US); Zachary Paul Snopkowski, Southbury, CT (US); Ryan Porcasi, Franklin Square, NY (US)

(73) Assignee: L&S PRESTIGE LLC, Franklin Square, NY (US)

( * ) Notice: Subject to any disclaimer, the term of this patent is extended or adjusted under 35 U.S.C. 154(b) by 0 days.

(21) Appl. No.: 17/220,123

(22) Filed: Apr. 1, 2021

(65) Prior Publication Data

US 2021/0308517 A1 Oct. 7, 2021

Related U.S. Application Data

(60) Provisional application No. 63/005,032, filed on Apr. 3, 2020.

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC ... A63B 21/06; A63B 21/0601; A63B 21/072; A63B 21/0722; A63B 21/0724; A63B 21/0726; A63B 21/0728; A63B 21/075; A63B 21/078
See application file for complete search history.

(56) References Cited

U.S. PATENT DOCUMENTS 4,646,398 A * 3/1987 Myhrman ..... A63B 21/0728 24/527
4,893,810 A * 1/1990 Lee ..... A63B 21/0728 24/115 L
4,955,603 A 9/1990 Becker
5,346,449 A 9/1994 Schlagel
(Continued)

FOREIGN PATENT DOCUMENTS

WO 2020052815 A1 3/2020

*Primary Examiner* — Loan B Jimenez
*Assistant Examiner* — Zachary T Moore
(74) *Attorney, Agent, or Firm* — DeLio Peterson & Curcio LLC; Brian G. Schlosser

(57) ABSTRACT

Apparatus for securing weighted plates to a barbell or dumbbell, and a method of use thereof. A mounting subassembly includes an actuator for expanding and retracting the mounting subassembly, and a mount for securing the mounting subassembly to an edge of a sleeve or handlebar of the barbell or dumbbell. A locking subassembly is disposed about the mounting subassembly in a collapsed state. Weighted plates may be placed over the mounting subassembly and locking subassembly on the barbell or dumbbell sleeve when both are in their retracted and collapsed states, respectively. The locking subassembly is expandable to a diameter larger than the barbell or dumbbell sleeve via engagement of the actuator to expand the mounting subassembly. The locking subassembly may then slide up the sleeve, and rest against the weighted plates to secure them in place on the barbell or dumbbell.

28 Claims, 23 Drawing Sheets

(56) References Cited

U.S. PATENT DOCUMENTS

| | | | | |
|---|---|---|---|---|
| 5,605,411 | A * | 2/1997 | Wilson | A63B 21/0728 403/109.8 |
| 5,697,871 | A * | 12/1997 | Landfair | A63B 5/20 482/81 |
| 7,087,000 | B1 | 8/2006 | Walker | |
| 7,811,213 | B2 | 10/2010 | Chen | |
| 7,887,469 | B1 | 2/2011 | Chen | |
| 8,932,188 | B2 * | 1/2015 | Svenberg | A63B 21/0728 482/106 |
| 9,314,661 | B1 | 4/2016 | Chen | |
| 9,764,183 | B2 * | 9/2017 | Roepke | A63B 21/0728 |
| 9,889,331 | B2 | 2/2018 | Svenberg et al. | |
| 11,213,714 | B2 * | 1/2022 | Hansen | A63B 21/0728 |
| 2005/0079961 | A1 * | 4/2005 | Dalebout | A63B 21/0728 482/106 |
| 2008/0200316 | A1 | 8/2008 | Shillington | |
| 2012/0302411 | A1 * | 11/2012 | Cen | A63B 21/0728 482/107 |
| 2016/0310782 | A1 * | 10/2016 | Slaughter | A63B 21/0783 |
| 2021/0016126 | A1 * | 1/2021 | Huang | A63B 21/0728 |

* cited by examiner

BARBELL WEIGHT RETAINING MECHANISM AND METHOD OF USE

BACKGROUND OF THE INVENTION

1. Field of the Invention

The present invention relates to an apparatus for retaining weighted plates on a barbell, dumbbell, T-bar, or any other type of weight loading bar, and more specifically to an assembly that easily attaches to a barbell/dumbbell and can be actuated to release a weight retaining mechanism for retaining weighted plates placed on said weight loading bar.

2. Description of Related Art

Barbells and dumbbells are essential products within the fitness industry. Many barbells utilize sleeves on either end of the central bar that are supported by bushings, bearings, etc. in order for the sleeves to rotate freely while secured to the central bar. The sleeve supports the weight plates users put on and take off of the barbell.

Safety products exist for securing the weight plates to the sleeves of the barbell after the weight plates are placed on the barbell (i.e. by sliding the plates onto the sleeves through a bore present in the axial center of each plate). This prevents the weight plates from sliding off of the barbell during its use.

The current products that are used to secure the weight plates present several issues, however. They can be hard to open to a diameter wide enough to slide over the barbell sleeve, difficult to find since a limited number of them are typically available at gyms (particularly during peak hours), or generally ineffective and prone to sliding off due to overuse. In turn, these products are swapped around from barbell to barbell, and therefore are not very convenient.

The present invention thus presents a convenient, effective, efficient, safe, and time-saving alternative to the currently existing products described above. The present invention may further prevent lawsuit-type injuries from occurring in a commercial gym setting.

SUMMARY OF THE INVENTION

Bearing in mind the problems and deficiencies of the prior art, it is therefore an object of the present invention to provide a barbell weight retaining mechanism comprising an assembly that can be easily attached to the sleeves or handle bar of currently-existing barbells without necessitating any modification of said barbell.

It is another object of the present invention to provide a weight retaining mechanism that can be easily stored on or within the edge of barbell sleeves, or on the edge of a handlebar, in a manner that is cost effective.

A further object of the invention is to provide a weight retaining mechanism that mitigates the risk of fitness-related injuries.

Still other objects and advantages of the invention will in part be obvious and will in part be apparent from the specification.

The above and other objects, which will be apparent to those skilled in the art, are achieved in the present invention which is directed to an assembly for securing a weight plate to a barbell. A barbell has a length, a handle bar with an edge and a first diameter, and at least one sleeve with an edge and a second diameter, wherein the handlebar first diameter is smaller than the at least one sleeve second diameter. A mounting subassembly is attached to the at least one sleeve or handlebar of the barbell, and comprises an actuator for translating the mounting subassembly from a retracted state to an expanded state. A weight retaining mechanism is expandable to an expanded state having a diameter greater than that of the at least one sleeve second diameter, and is retractable to a collapsed state having a diameter lesser than that of the at least one sleeve second diameter. The weight retaining mechanism is disposed about the mounting subassembly when in the collapsed state. Engagement of the mounting subassembly actuator translates the mounting subassembly to its expanded state, and simultaneously expands the weight retaining mechanism disposed thereon to its expanded state, which allows the weight retaining mechanism to slide over the at least one sleeve along its length to secure the weight plate to the barbell.

In an embodiment, the barbell at least one sleeve edge may further include a cavity, and the mounting subassembly may include a friction mount for insertion into the cavity of the at least one sleeve. Alternatively, the barbell at least on sleeve edge may further include a cavity and a snap ring disposed therein, and the mounting subassembly may include a snap ring mount for insertion into the cavity of the at least one sleeve. The snap ring may further include a slot, and the snap ring mount may further include a ram having a lip for reception by the snap ring slot once the snap ring mount is inserted into the cavity containing the snap ring. Alternatively, the at least one sleeve may float on the handle bar, and the mounting subassembly may include an end cap mount having a hollow cavity for receiving the edge of the handle bar. The end cap mount may be securable up against the at least one sleeve and onto the handle bar via a pin that is received by through holes on both a body of the end cap mount, and the edge of the handle bar.

The mounting subassembly may further include a central support having a base plate and a hollow projection. Pin retainers may be radially disposed around the actuator, and have radial wedge pins disposed therebetween. The radial wedge pins may further be received by radial wedges. The hollow projection may further include a central channel disposed thereon, and the actuator may be a button having a button flange for reception by the hollow projection central channel. Alternatively, the hollow projection may include a threaded body, and the actuator may be a knob having a threaded interior surface for reception by the threaded body of the hollow projection.

The present invention also provides a method for securing a weight plate to a barbell. The method provides: at least one weight plate; a barbell having a length, a handle bar having an edge and a first diameter, and at least one sleeve having an edge and a second diameter, wherein the handle bar first diameter is smaller than the at least one sleeve second diameter; a mounting subassembly attachable to the edge of the at least one sleeve or handlebar of the barbell, the mounting subassembly comprising an actuator for translating the mounting subassembly to a retracted state and an expanded state; and a weight retaining mechanism translatable to an expanded state where the weight retaining mechanism has a diameter greater than that of the at least one sleeve second diameter, and to a collapsed state where the weight retaining mechanism has a diameter lesser than that of the at least one sleeve second diameter, the weight retaining mechanism being disposed about the mounting sleeve subassembly. The steps of the method include: attaching the mounting subassembly to the edge of the at least one sleeve of the barbell; sliding the at least one weight plate over both the mounting subassembly and weight retaining mechanism onto the at least one sleeve; engaging the actuator to translate the mounting subassembly from the retracted state to the expanded state; translating the weight retaining mechanism to its expanded state; sliding the weight retaining mechanism over the at least one sleeve; pushing the weight retaining mechanism up against the at least one weight plate; and securing the at least one weight plate to the at least one sleeve via the weight retaining mechanism.

In an embodiment, the method may further provide: a cavity on the at least one sleeve edge; and a friction mount disposed on the mounting subassembly, the friction mount having an elongated body and a ram, the ram being engageable by a fastener disposed in the friction mount elongated body. Steps may further include: inserting the elongated body of the friction mount into the cavity of the at least one sleeve edge; engaging the fastener to interact with the ram and drive the ram out from the elongated body; and clamping the mounting subassembly into the at least one sleeve cavity. Alternatively, the method may further provide: a cavity on the at least one sleeve edge, the cavity having a snap ring with a snap ring groove disposed therein; and a snap ring mount disposed on the mounting subassembly, the snap ring mount having an elongated body and a ram having a lip, the ram being engageable by a fastener disposed in the snap ring mount elongated body. The steps may further include: inserting the elongated body of the snap ring mount into the cavity of the at least one sleeve edge; engaging the fastener to interact with the ram and drive the ram out from the elongated body; catching the lip of the ram onto the snap ring groove within the cavity; and locking the mounting subassembly into the at least one sleeve cavity. Alternatively, the method may further provide: the at least one sleeve floating on the handle bar, and the at least one sleeve is secured to the handle bar via an end cap which is disposed on the edge of the handle bar; a through hole bored into the edge of the handle bar; an end cap mount disposed on the mounting subassembly, the end cap mount having a body with a hollow cavity for receiving the edge of the handle bar, and a through hole bored through the end cap mount body; and a pin sized to fit into the through hole of the end cap mount body. Steps may further include: removing the end cap disposed on the handle bar; placing the body of the end cap mount over the edge of the handle bar, such that the hollow cavity of the end cap mount body receives the edge of the handle bar, and the body through hole aligns with the through hole of the handle bar; pushing the pin into the aligned through holes of the end cap mount body and the handle bar edge; and securing the mounting subassembly to the at least one sleeve.

In an embodiment, the method may further provide: a central support of the mounting subassembly, the central support having a base plate and a hollow projection; and pin retainers radially disposed around the actuator, the pin retainers having radial wedge pins disposed therebetween, the radial wedge pins further being received by radial wedges upon which the weight retaining mechanism is disposed thereon. The step of engaging the actuator to translate the mounting subassembly from the retracted state to the expanded state may further include: moving the actuator, pin retainers, and radial wedge pins axially down the length of the central support hollow projection; and pushing the radial wedges outward. The method may further provide a central channel disposed on the central support hollow projection. The actuator may be a button comprising a button bore and a button flange disposed within the button bore. The step of engaging the actuator may then include pushing the button axially inward such that the button flange travels down the length of the central channel. The method may further provide a locking groove, and a stopping wall disposed on the central support hollow projection adjacent to the central channel, the button flange sized to fit in the locking groove and move from the locking groove to the central channel. When the button flange is disposed in the locking groove, the step of pushing the button axially inward may be prevented via the button flange contacting the stopping wall. The button may further be translatable between a locked state where the button flange is disposed in the locking groove, and an unlocked state where the button flange is disposed in the central channel. The method may still further provide the button in the locked state. Steps may further include rotating the button into the unlocked state such that the button flange moves from the locking groove to the central channel, prior to the step of pushing the button axially inward.

In an embodiment, the actuator may be a knob with a threaded interior surface, the central support hollow projection may include a threaded body, and the step of engaging the actuator may include rotating the knob to move the knob axially down the length of the central support hollow projection.

The present invention further provides an assembly for securing a weight plate to a barbell. A mounting subassembly is attached to an edge of at least one sleeve or handlebar of a barbell. The mounting subassembly comprises an actuator for translating the mounting subassembly from a retracted state to an expanded state. A weight retaining mechanism is expandable to a diameter greater than a diameter of the at least one sleeve of the barbell, and retractable, and is further capable of being disposed about the mounting subassembly. The weight retaining mechanism includes a toggle lever.

In an embodiment, the mounting subassembly may further include a central support having a base plate and a hollow projection. Pin retainers may be radially disposed around the actuator, and have radial wedge pins disposed therebetween. The radial wedge pins may further be received by radial wedges. The hollow projection may further include a central channel disposed thereon, and the actuator may be a button having a button flange for reception by the hollow projection channel. The hollow projection may further include a locking groove disposed adjacent the central channel, and the button may be rotatable such that the button flange may travel between the central channel and locking groove.

Alternatively, the hollow projection may further include a threaded body, and the actuator may be a knob having a threaded interior surface for reception by the threaded body of the hollow projection. The radial wedge pins disposed between the pin retainers may be slightly tapered inward.

In an embodiment, the weight retaining mechanism may further include a series of larger links and smaller links interlocked with each other, the larger links being slightly bent inward. The weight retaining mechanism may further include a friction pad. The toggle lever may be closed to tighten the weight retaining mechanism, and may be opened to loosen the weight retaining mechanism. The weight retaining mechanism may be automatically pushed up onto the at least one sleeve of the barbell via a push spring action as the mounting subassembly actuator is engaged to translate the mounting subassembly to the expanded state.

The present invention still further provides a method for expanding a weight retaining mechanism. The method provides: a mounting subassembly comprising an actuator for translating the mounting subassembly from a retracted state to an expanded state; and a weight retaining mechanism expandable to a larger diameter and retractable to a smaller diameter, the weight retaining mechanism disposed about the mounting subassembly. The method steps include: engaging the actuator to translate the mounting subassembly from the retracted state to the expanded state; and translating the weight retaining mechanism to an expanded state.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
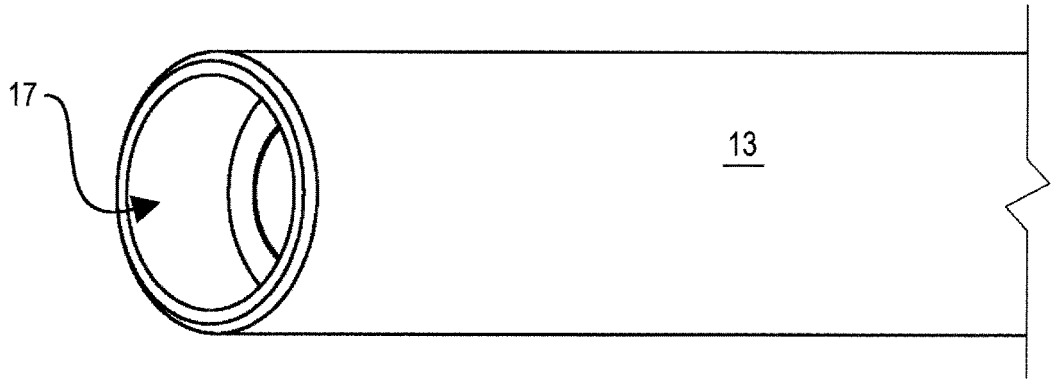
FIG. 1 is a partial side perspective view of a barbell sleeve and cavity.

In describing the embodiment(s) of the present invention, reference will be made herein to FIGS. 1-51 of the drawings in which like numerals refer to like features of the invention.

The present invention may be interactive with a standard dumbbell or barbell 10 found in commercial gyms, as shown in FIGS. 1-5. For purposes of this description, the term "barbell" herein refers to any of a dumbbell, barbell, T-bar, or other weight loading bar commonly found in commercial gyms, and should not be construed as being limited strictly to barbells.

These barbells 10 typically comprise a handle 12 having a first diameter, sleeves 13 extending from either end of the handle 12 (or a singular sleeve 13 extending from one end of the handle, such as in the case of a T-bar), the sleeves having a second diameter larger than the first diameter, and sleeve stops 14 between the handle bar 12 and each of the sleeves 13. The sleeves and handle are all in axial alignment, and share the same longitudinal axis 11. Weight plates 15 (varying in weight from 1.25 lbs (0.6 kg) to 100 lbs (45 kg), most commonly between 2.5 lbs 1.1 kg) (to 45 lbs (20 kg)) each comprise a bore 16 through their axial centers, the bore having a diameter at least slightly larger than the sleeves' 13 second diameter so as to allow for a sliding reception of at least one weight plate 15 by the sleeves.

Figure 2:
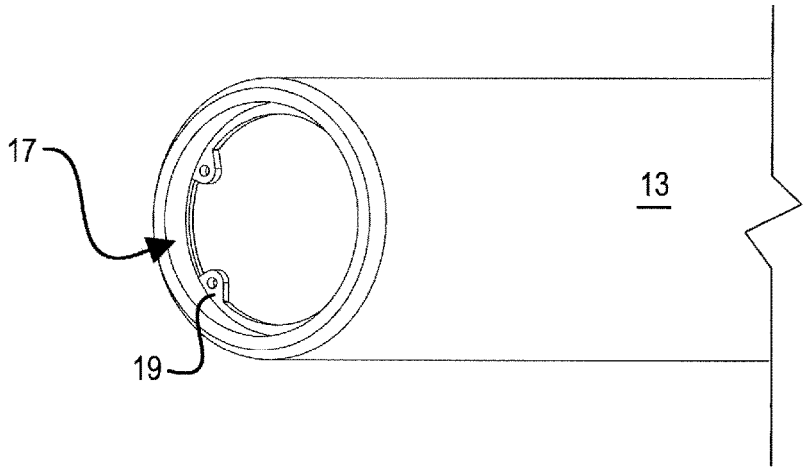
FIG. 2 is a partial side perspective view of a barbell sleeve and shallower cavity sized for receiving a snap ring.
Figure 3:
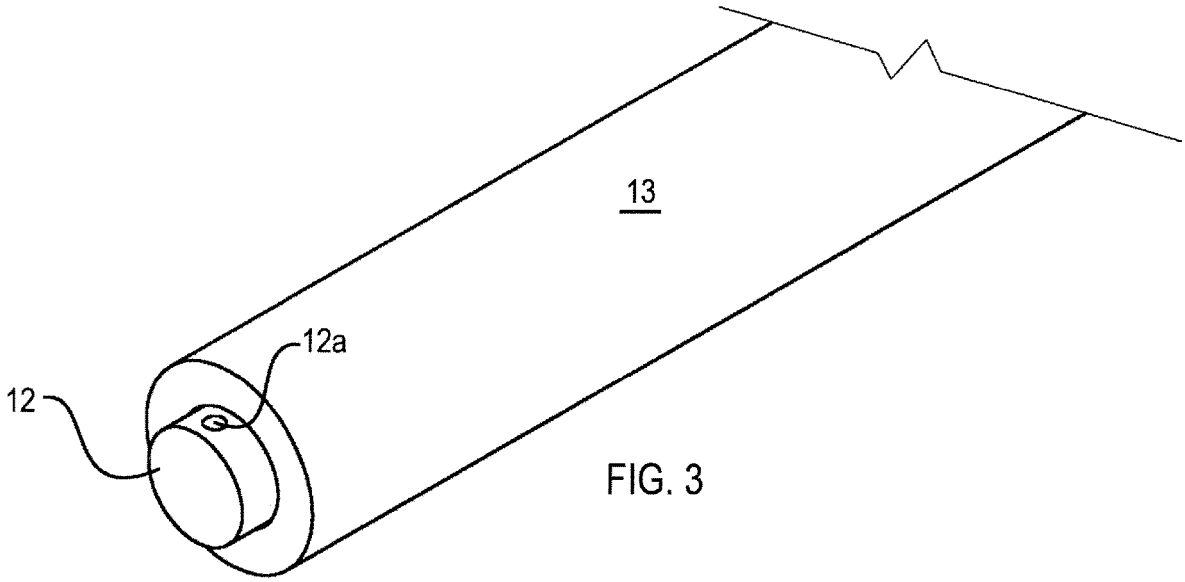
FIG. 3 is a partial perspective view of a barbell sleeve floating on a handle bar, the handle bar which has a through hole for receiving an end cap to secure the barbell sleeve in place.
Figure 4:
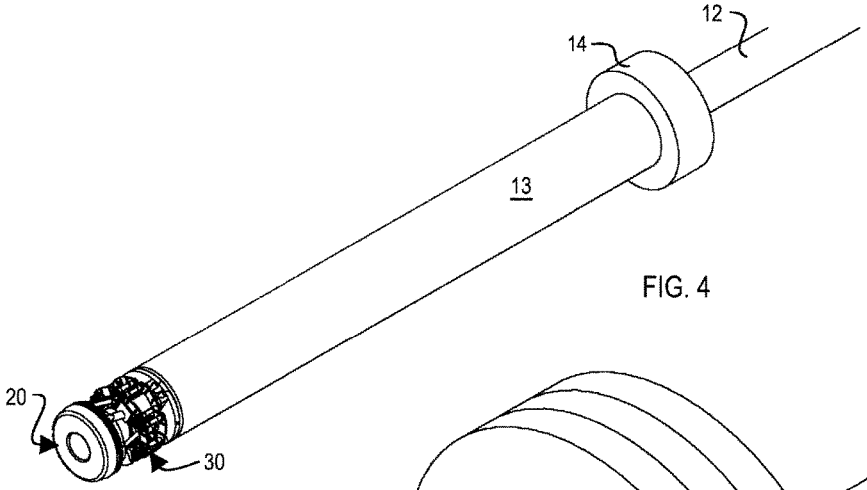
FIG. 4 is a partial perspective view of a barbell with a mounting subassembly and weight retaining mechanism of the present invention attached to its sleeve.
Figure 5:
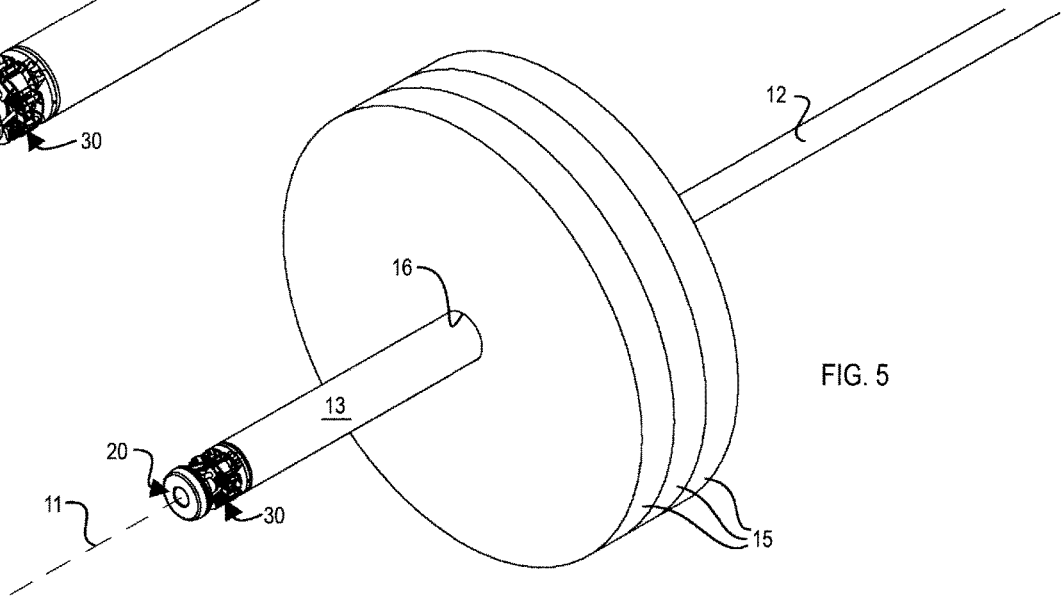
FIG. 5 is a partial perspective view of the barbell, mounting subassembly, and weight retaining mechanism of FIG. 4 with weight plates retained on the barbell sleeve.

The sleeves 13 may be affixed on the handle bar 12 in a variety of ways. In one embodiment, the sleeve 13 has a cavity 17 disposed on its outermost edge, as shown in FIG. 1. In another embodiment, the cavity 17 is shallower, and an internal snap ring 19 is provided to retain the sleeve onto the handle bar, as shown in FIG. 2. These snap rings have gaps between its ends, where a snap ring groove is exposed. In yet another embodiment, the sleeve 13 floats on the handle bar 12 (which may be further supported with bushings and/or bearings), with the handle bar extending past the outermost edge of the sleeve 13, as shown in FIG. 3. The handle bar 12 has a thru-hole 12*a* near its edge to allow for an end cap 18 to be pinned to the handle bar, which in turn locks the sleeve 13 in place (and retains the bushings and/or bearings if provided).

The present invention may utilize two subassemblies. A mounting subassembly 20 is securable to the barbell sleeves 13 or handle bar 12 and the locking subassembly 30 (also referred to herein as the weight retaining mechanism 30) is securable to the mounting subassembly 20, engageable by the mounting subassembly, and slideable along the barbell sleeves. Both subassemblies may have a diameter the same as or smaller than the outer diameter of the barbell sleeve (i.e. smaller than the central bore of the weight plates) so as to prevent interference when a user adds or removes weight plates 15 to/from the sleeves 13 while the invention is not in use.

Figure 6:
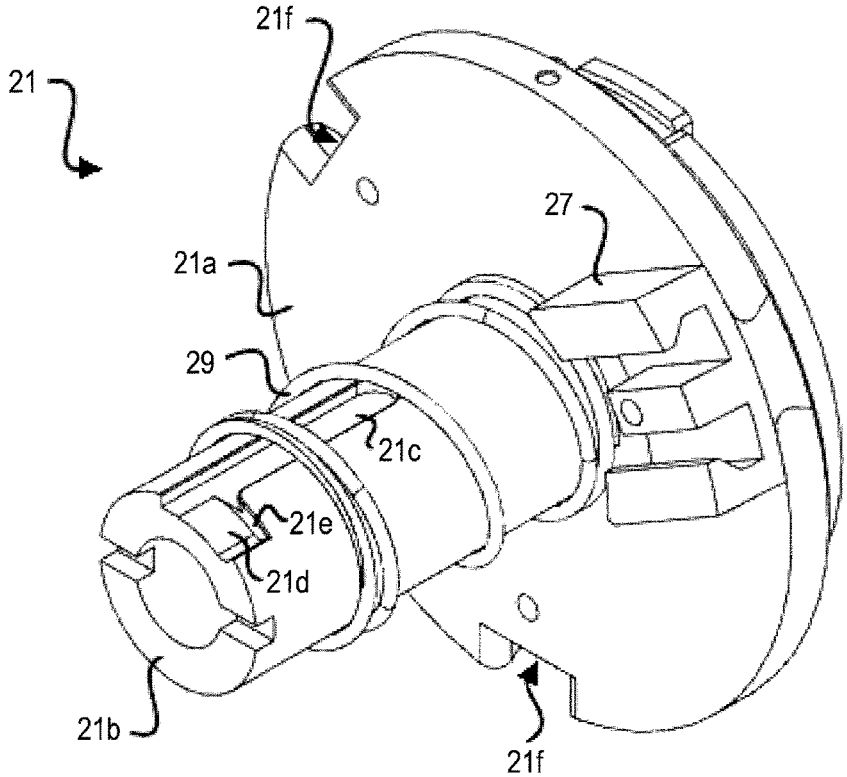
FIG. 6 is a perspective view of a central support of the mounting subassembly of the present invention, excluding some components for easier visibility.
Figure 7:
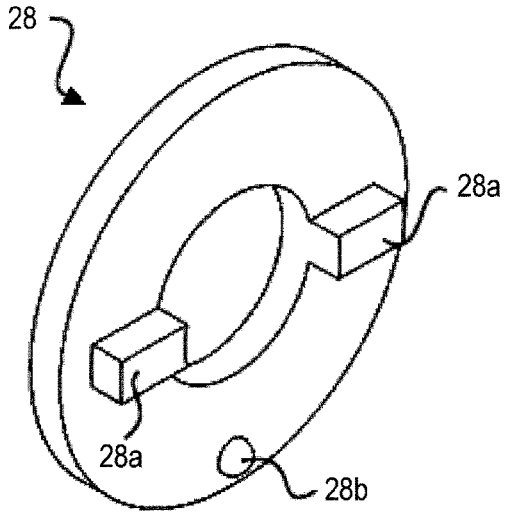
FIG. 7 is a perspective view of a retaining washer received by an edge of a hollow projection of the central support of FIG. 6.
Figure 8:
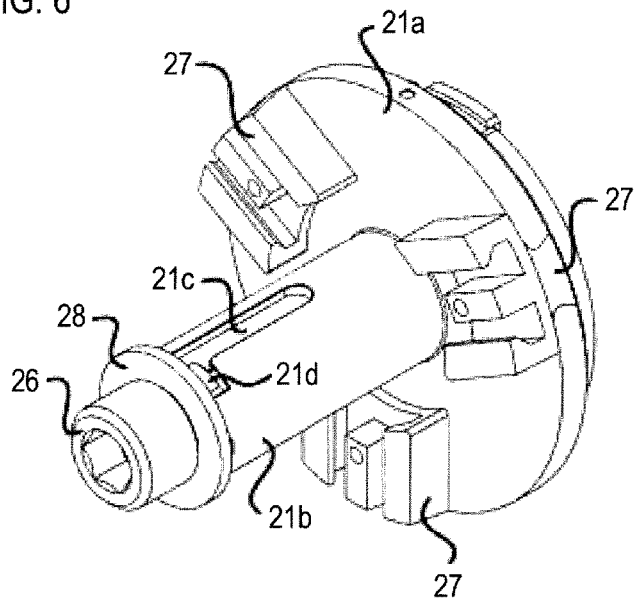
FIG. 8 is another perspective view of the central support of the mounting subassembly of FIG. 6, including more components not previously shown in FIG. 6.
Figure 9:
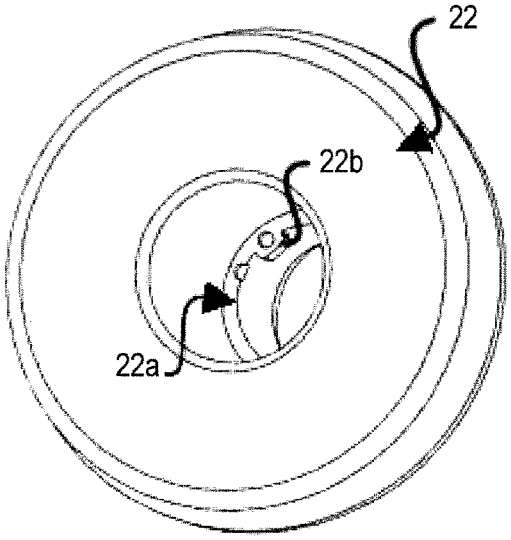
FIG. 9 is a perspective view of an actuator of the mounting subassembly of the present invention.
Figure 10:
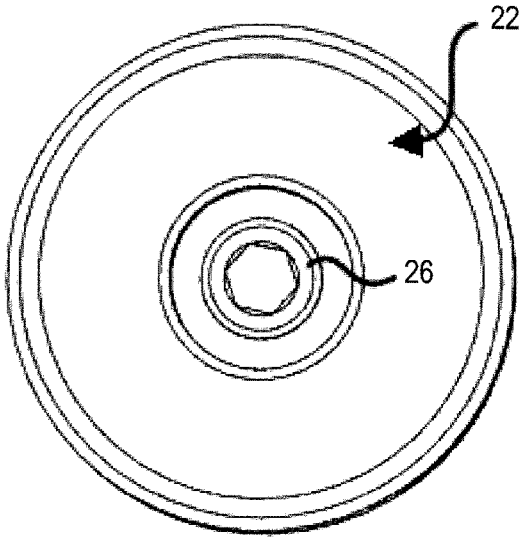
FIG. 10 is a top elevational view of the actuator of FIG. 9 including a main fastener disposed in a bore of the actuator.
Figure 11:
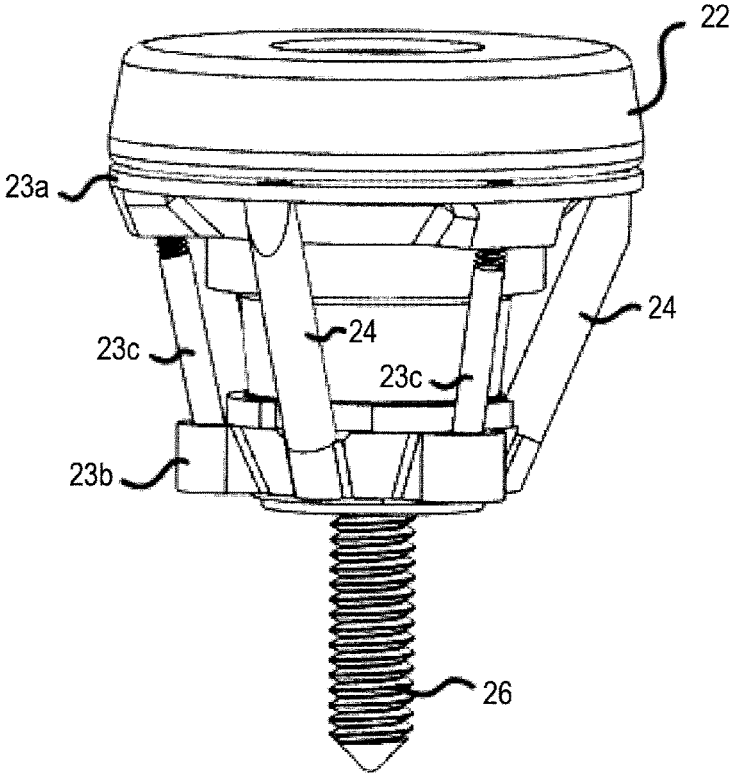
FIG. 11 is a side elevational view of the actuator of FIGS. 9-10, further showing pin retainers and related components disposed on the actuator of the mounting subassembly of the present invention.
Figure 12:
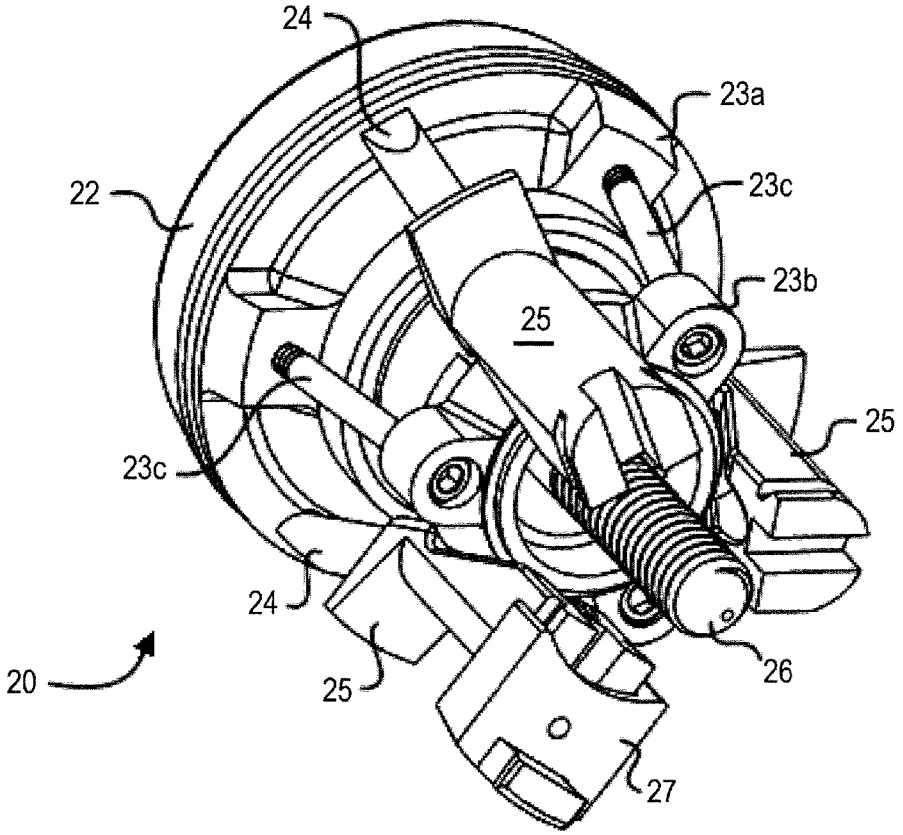
FIG. 12 is another perspective view of the actuator, pin retainers, and related components of the mounting subassembly of FIG. 11, including more components not previously shown in FIG. 11.
Figure 13:
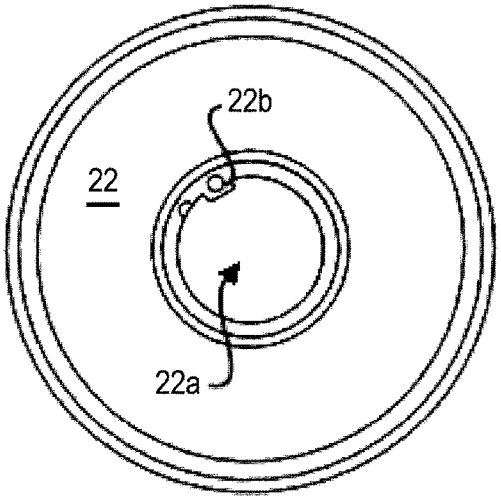
FIG. 13 is a top elevational view of the actuator of FIG. 9.
Figure 14:
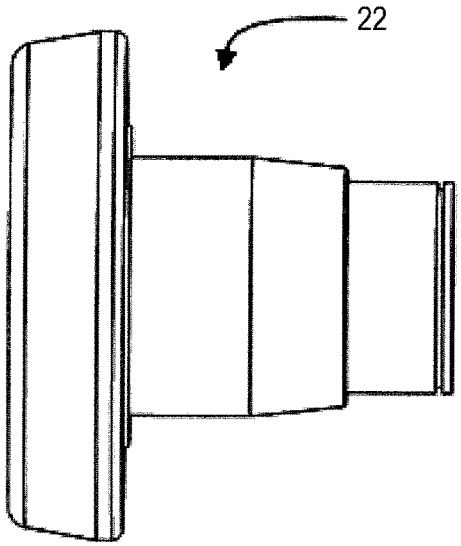
FIG. 14 is a side elevational view of the actuator of FIG. 9.
Figure 15:
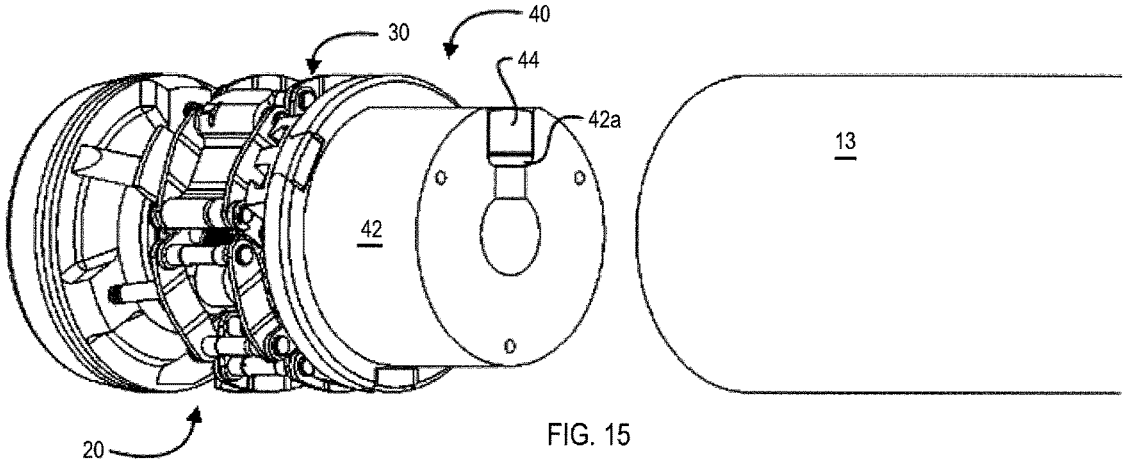
FIG. 15 is a rear perspective view of the mounting subassembly and weight retaining mechanism of the present invention utilizing a friction mount for connecting to the barbell sleeve of FIG. 1.
Figure 16:
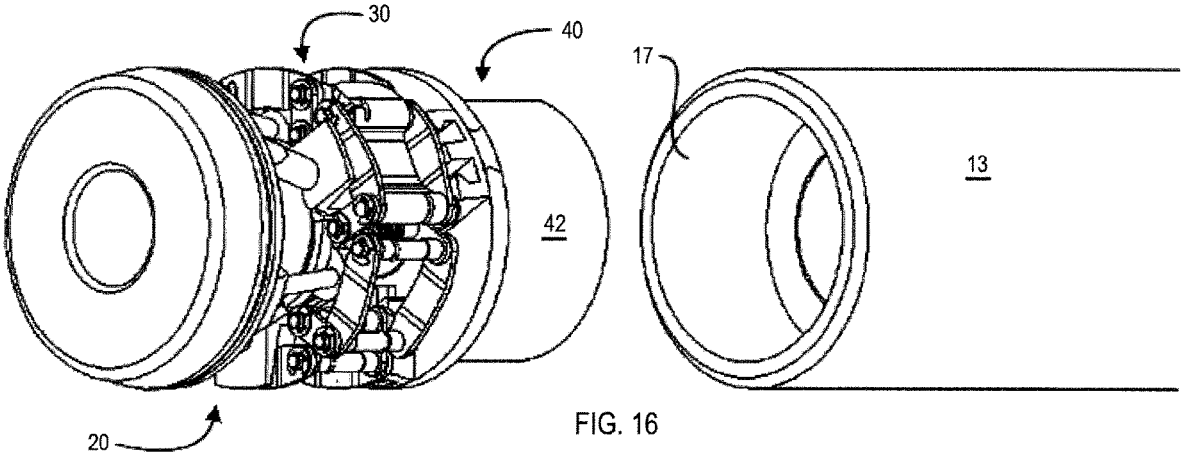
FIG. 16 is a front perspective view of the mounting subassembly, weight retaining mechanism, and friction mount of FIG. 15.

As shown in greater detail in FIGS. 6-8, the mounting subassembly 20 comprises a central support 21 having a base plate 21*a* with slots 21*f* cut into its radial edges, and a bored or hollow projection 21*b* extending from the base plate's radial center, perpendicular to the base plate's surface. A central channel 21*c* runs at least partially down the length of the hollow projection 21*b*. Adjacent and extending perpendicular to channel 21*c* is a locking groove 21*d*, the locking groove which has a stopping wall 21*e* at its edge formed by the body of the projection 21*b* that is not carved out via the channel 21*c* and groove 21*d*.

An actuator or button 22 which is tapered inward for all or at least a portion of its body comprises a bore 22*a* running through its axial center, the bore being sized to receive and overlap the hollow projection 21*b*, as shown in FIGS. 9-14. A button flange 22*b* partially protrudes inward from the button bore's inner surface, and is received within the channel 21*c* and locking groove 21*d* of the projection 21*b*. A retaining washer 28 also comprising a bore in its axial center is received within the bore 22*a* of the button 22 and is sized to fit on the edge of projection 21*b*. The washer 28 has at least one flange 28*a* and a protuberance 28*b* extending from its surface, the at least one flange 28*a* being received by a complimentary groove on the projection 21*b* edge to keep the washer in place, and the protuberance 28*b* lining up with the channel 21*c* and groove 21*d* once fully assembled. A fastener 26 may be inserted into the button bore 22*a* once the button 22 receives the projection 21*b*, and the washer 28 is disposed in the button 22, such that the fastener secures the washer 28 in place within the button 22 and secures the button 22, washer 28, and projection 21*b* in axial alignment. A compression spring 29 disposed over the projection 21*b* will bias the button away from the central support base plate 21*a* once fully assembled.

Pin retainers 23*a*, 23*b* are radially disposed around the body of the button 22, with each retainer 23*a*, 23*b* being spaced from each other on the length of the button's body. At least one pin retaining screw 23*c* connects the two pin retainers 23*a*, 23*b* and maintains their distance from each other. Further disposed between the pin retainers are radial wedge pins 24, which tapers inward (i.e. angled with respect to the longitudinal axis 11) from retainer 23*a* to retainer 23*b*. The lengths of the radial wedge pins 24 are further received by corresponding radial wedges 25. The corresponding radial wedges 25 are slotted into corresponding dovetail inserts 27, and the dovetail inserts 27 are received in the central support base plate 21*a* via the slots 21*f*.

Mounting Subassembly Connection Embodiments

The mounting subassembly 20 (and related components described above) connects to the barbells in question using a number of different connecting means, including but not limited to: snap fit, friction fit, threaded fit, end cap and pin structures, welding, glue/adhesive, magnetic attachments, and more. The present invention thus should not be limited to only the connecting means described below and presented in the figures of the drawings. These connection structures may be disposed and/or extend from the surface of central support base plate 21*a* that is opposite the hollow projection 21*b*.

Friction Mount Concept

A friction mount 40 may be used for connecting to barbells with sleeves 13 having a deep cavity 17, as previously described above and shown in FIG. 1. The friction mount 40 comprises an elongated body 42 having a slot 42*a* disposed in the body for receiving a ram 44, as shown in FIGS. 15-18. The diameter of body 42 is slightly less than or almost equal to the inner diameter of the cavity 17, such that reception of the body 42 by the cavity 17 results in a friction-inducing sliding fit. The body 42 may be comprised of any suitable material, and may further be coated with rubber to increase the frictional coefficient and create a tighter connection between the body 42 and the sleeve cavity 17.

Figure 17:
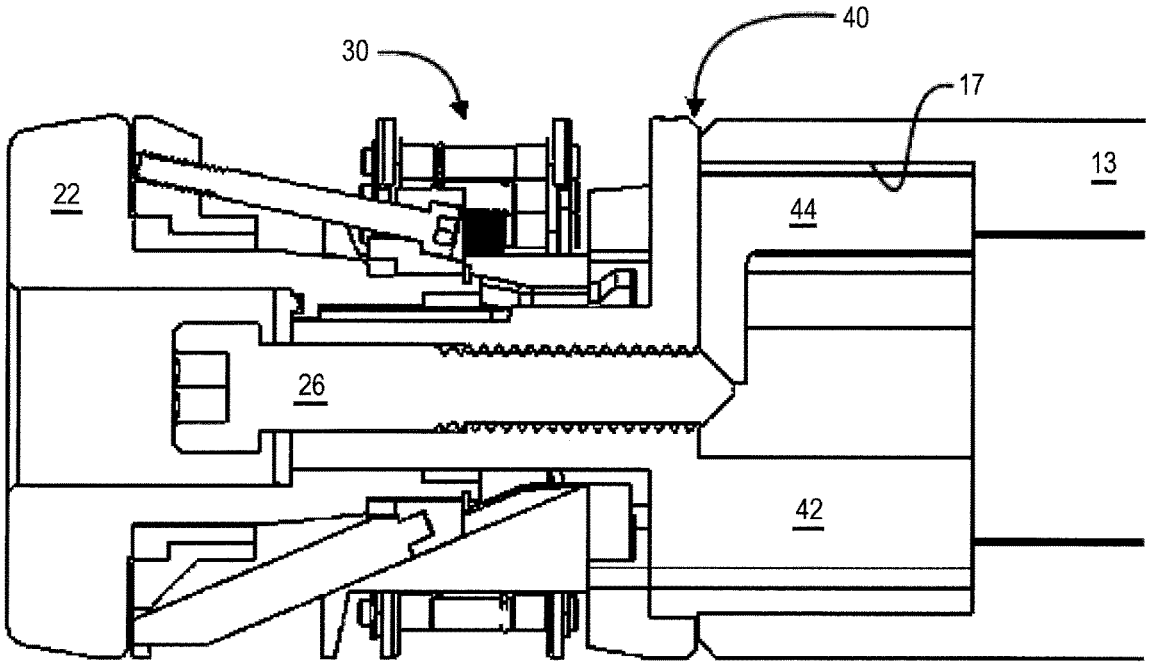
FIG. 17 is a side cross-sectional view of the mounting subassembly, weight retaining mechanism, and friction mount of FIG. 15 inserted into the barbell sleeve cavity, with a ram of the friction mount disengaged.
Figure 18:
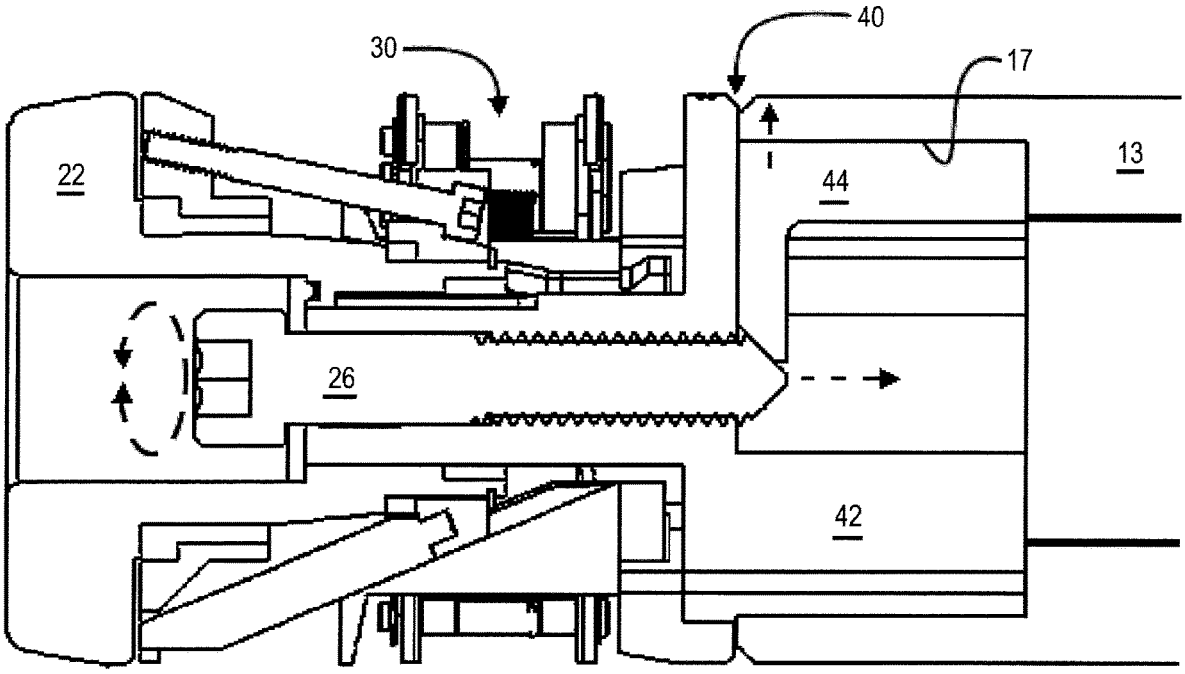
FIG. 18 is a side cross-sectional view of the mounting subassembly, weight retaining mechanism, and friction mount of FIG. 17 with the ram of the friction mount engaged, securing the mounting subassembly to the barbell sleeve.
Figure 19:
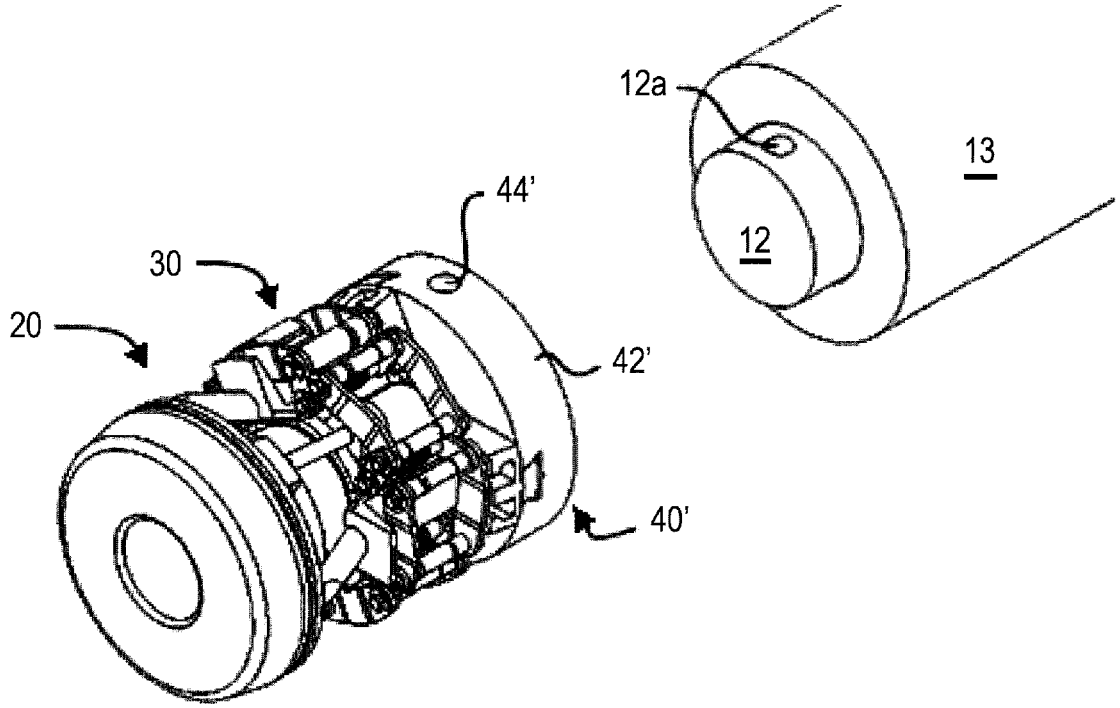
FIG. 19 is a front perspective view of the mounting subassembly and weight retaining mechanism of the present invention utilizing an end cap and pin mount for connecting to the barbell sleeve of FIG. 3.
Figure 20:
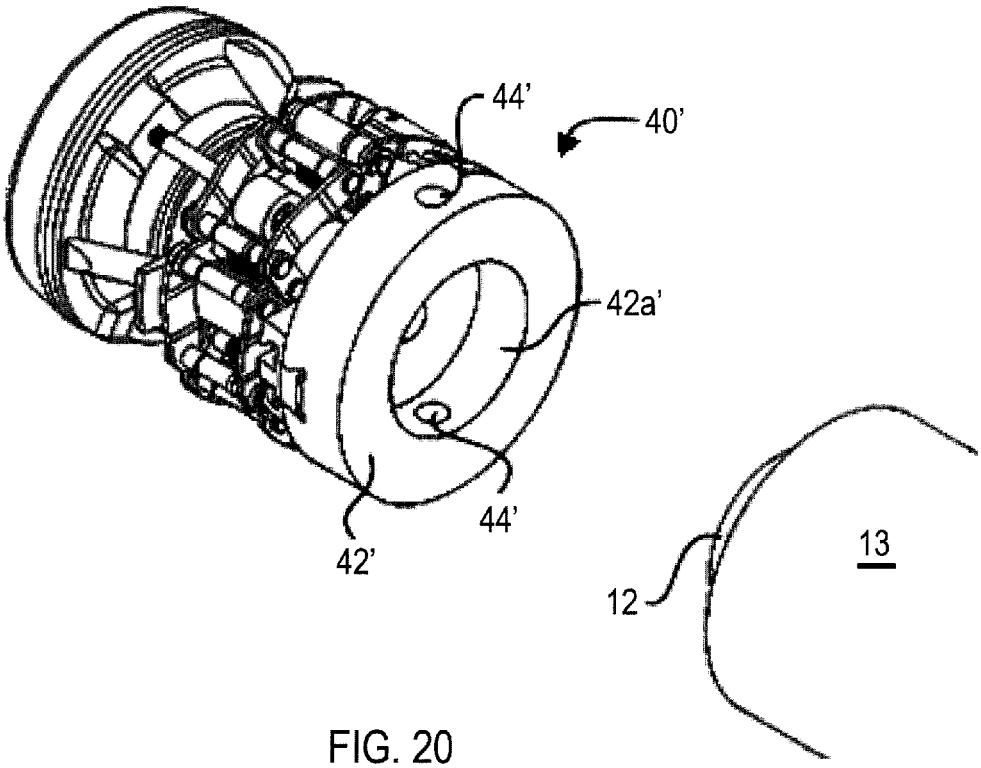
FIG. 20 is a rear perspective view of the mounting subassembly, weight retaining mechanism, and end cap mount of FIG. 19.
Figure 21:
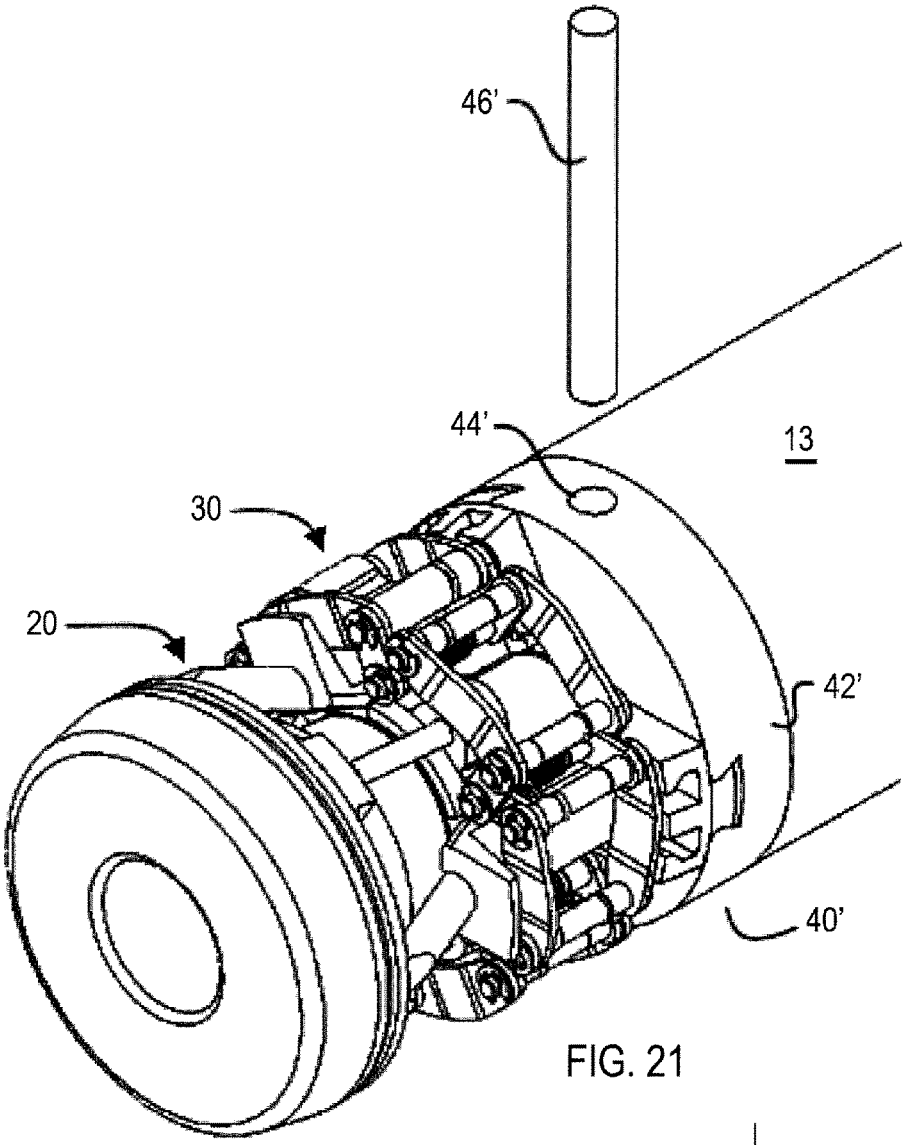
FIG. 21 is a front perspective view of the mounting subassembly, weight retaining mechanism, and end cap mount of FIG. 19 inserted over the handle bar adjacent to the barbell sleeve, with a pin being inserted into through holes of both the end cap mount body and handle bar edge.
Figure 22:
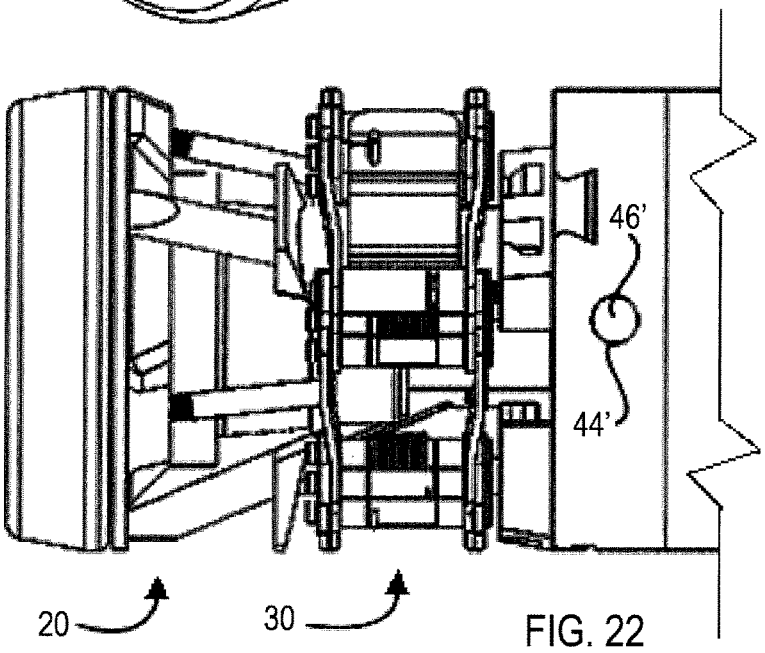
FIG. 22 is a partial side elevational view of the mounting subassembly, weight retaining mechanism, and end cap mount of FIG. 21 with the pin inserted through the end cap mount body and handle bar edge.
Figure 23:
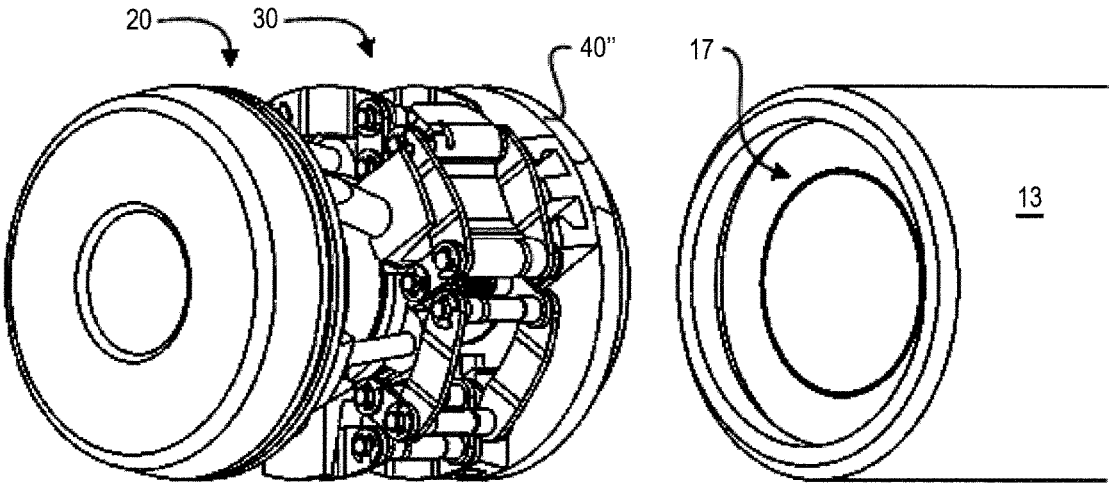
FIG. 23 is a front perspective view of the mounting subassembly and weight retaining mechanism of the present invention utilizing a snap ring mount for connecting to the barbell sleeve of FIG. 2.
Figure 24:
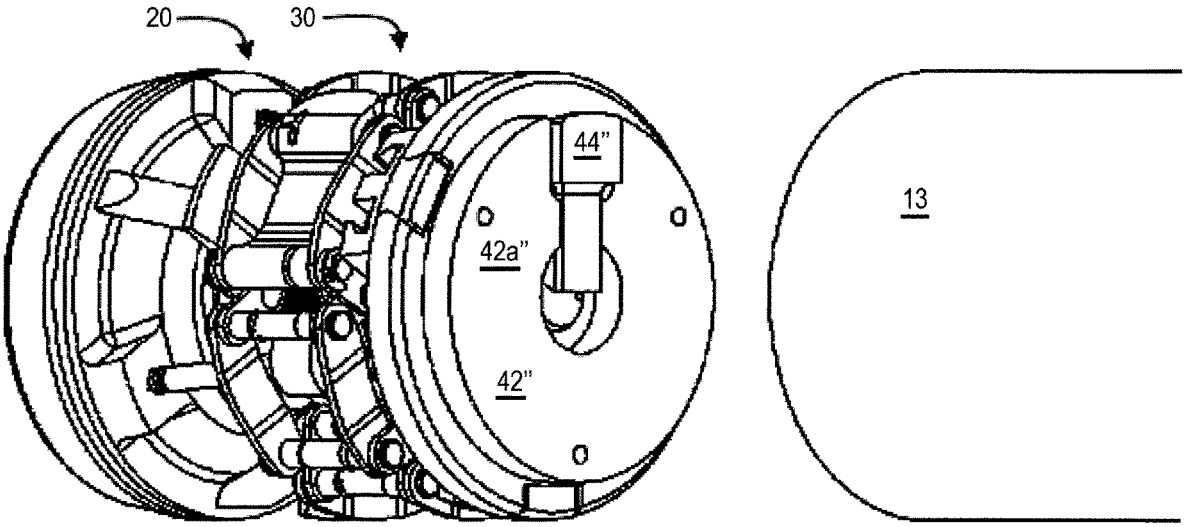
FIG. 24 is a rear perspective view of the mounting subassembly, weight retaining mechanism, and snap ring mount of FIG. 23.
Figure 25:
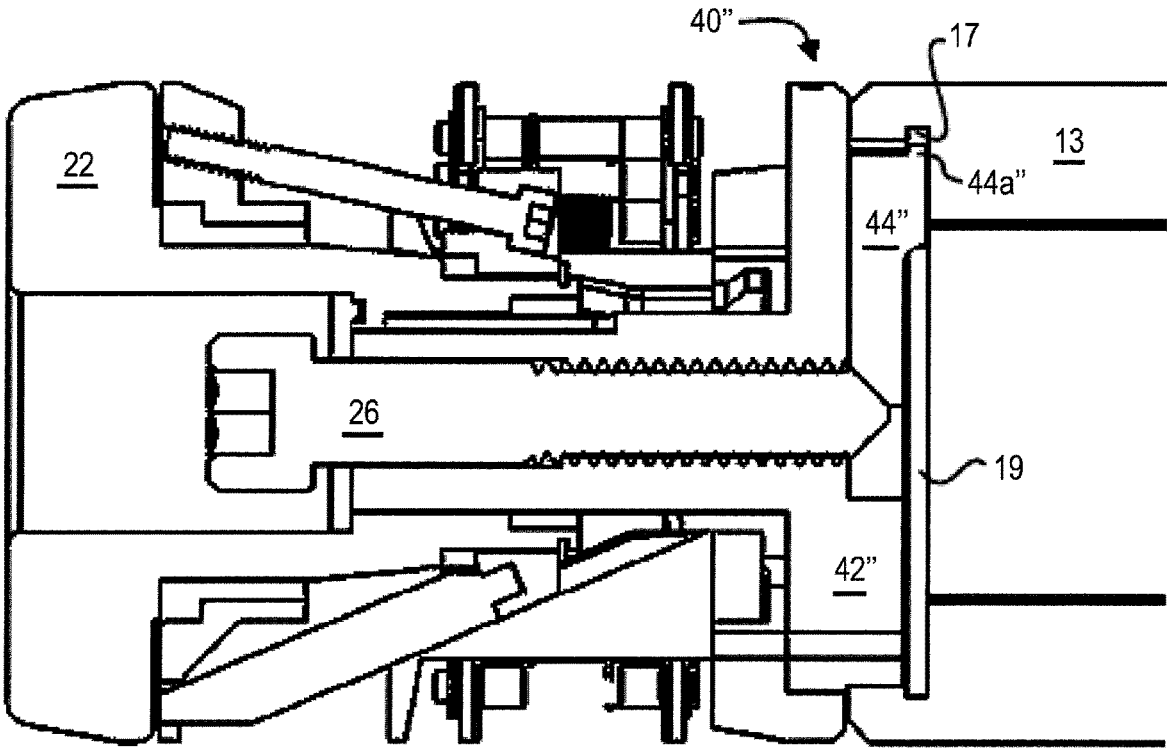
FIG. 25 is a side cross-sectional view of the mounting subassembly, weight retaining mechanism, and snap ring mount of FIG. 23.
Figure 26:
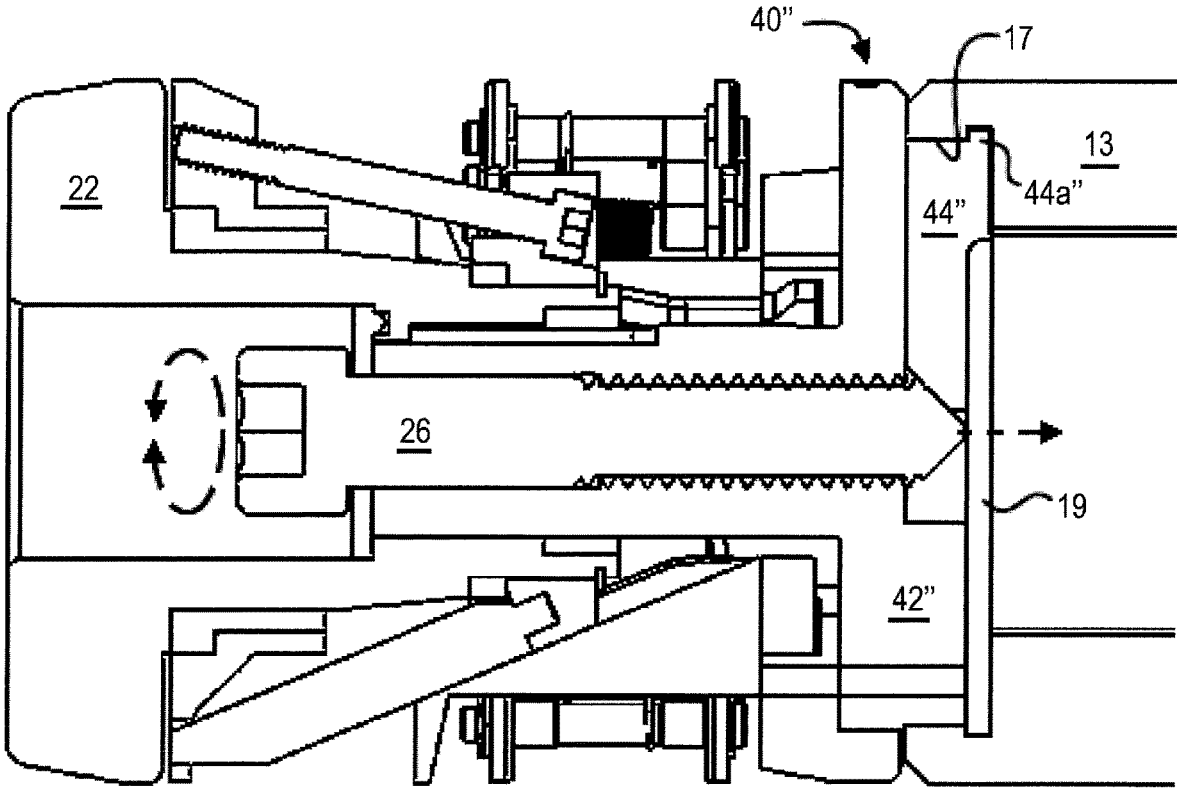
FIG. 26 is a side cross-sectional view of the mounting subassembly, weight retaining mechanism, and snap ring mount of FIG. 25 with the ram of the snap ring mount engaged, and a ram lip snapped in to the snap ring disposed in the barbell sleeve cavity.

Once the body 42 is received in the cavity, the fastener 26 may be engaged such that it is pushed or rotated further into the body 42, as shown in FIGS. 17-18. The fastener 26 will then engage ram 44, which results in the ram 44 being pushed out from the body 42 in a direction substantially perpendicular to the fastener 26. The ram 44 will then clamp onto—and be held in place within—the barbell cavity 17.

End Cap and Pin Concept

An end cap mount 40' is most suitable for connecting to barbells with sleeves 13 that float on the handle bar 12 (as described above) and are secured in place with the end cap and pin disposed on the edges of the handle bar 12, as previously described and shown in FIG. 3. The end cap mount 40' comprises a body 42' with a hollow cavity 42*a*' large enough to receive the edges of the handle bar 12, and a through hole running through the solid portions of the body 42' on radially opposite ends, as shown in FIGS. 19-22. A pin 44' is sized to be pushed through the through holes on both the body 42' and handle bar edges once they are aligned. The body 42' and pin 44' of the end cap mount 40' are meant to replace the conventional end cap and pin typically disposed on these types of barbells.

Internal Snap Ring Concept

A snap ring mount 40" is most suitable for connecting to barbells with sleeves 13 having a shallower cavity 17 and inclusory snap ring, as previously described and shown in FIG. 2. The snap ring mount 40" comprises an elongated body 42" having a slot 42*a*" disposed in the body for receiving a ram 44" having a lip 44*a*" protruding therefrom, as shown in FIGS. 23-26. The diameter of body 42" is slightly less than or almost equal to the inner diameter of the cavity 17".

Once the body 42" is received in the cavity, the fastener 26 may be engaged such that it is pushed or rotated further into the body 42". The fastener 26 will then engage ram 44", which results in the ram 44" being pushed out from the body 42" in a direction substantially perpendicular to the fastener 26. The ram lip 44*a*" will then catch onto the exposed snap ring groove and lock the mounting subassembly 20 in place.

Engagement of the Mounting Subassembly

Once the mounting subassembly 20 is locked onto the barbell 10 using one of the aforementioned mounts 40, 40', or 40", the subassembly can be properly engaged to interact with and expand the weight retaining mechanism 30.

Figure 27:
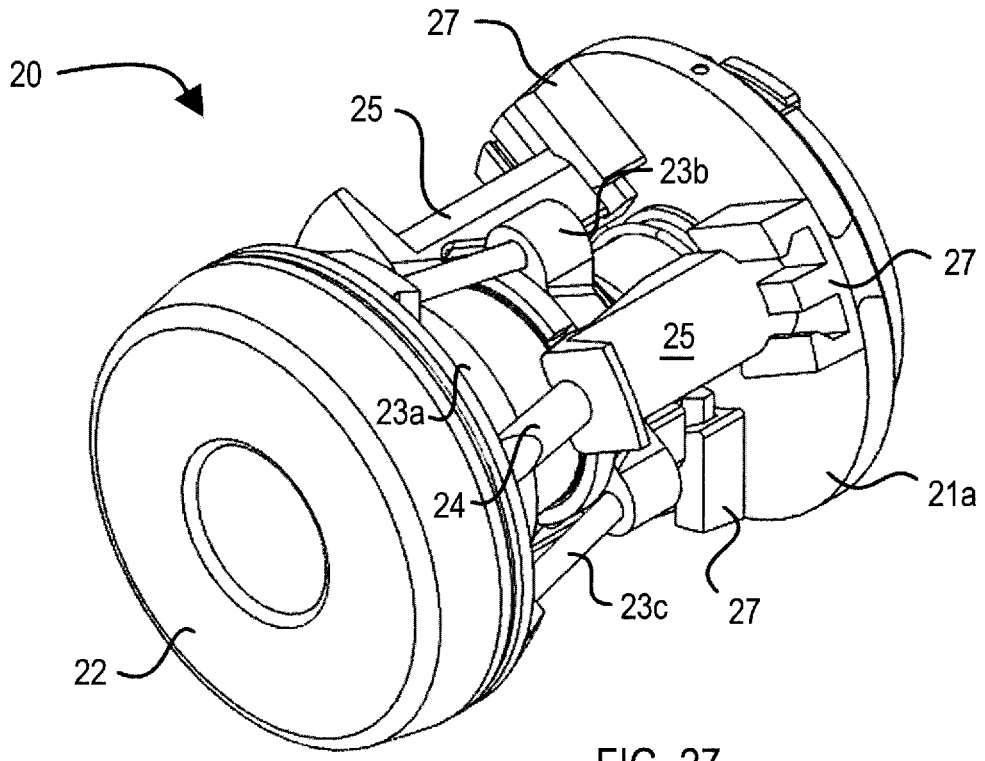
FIG. 27 is a perspective view of the fully assembled mounting subassembly of the present invention in its retracted state.
Figure 28:
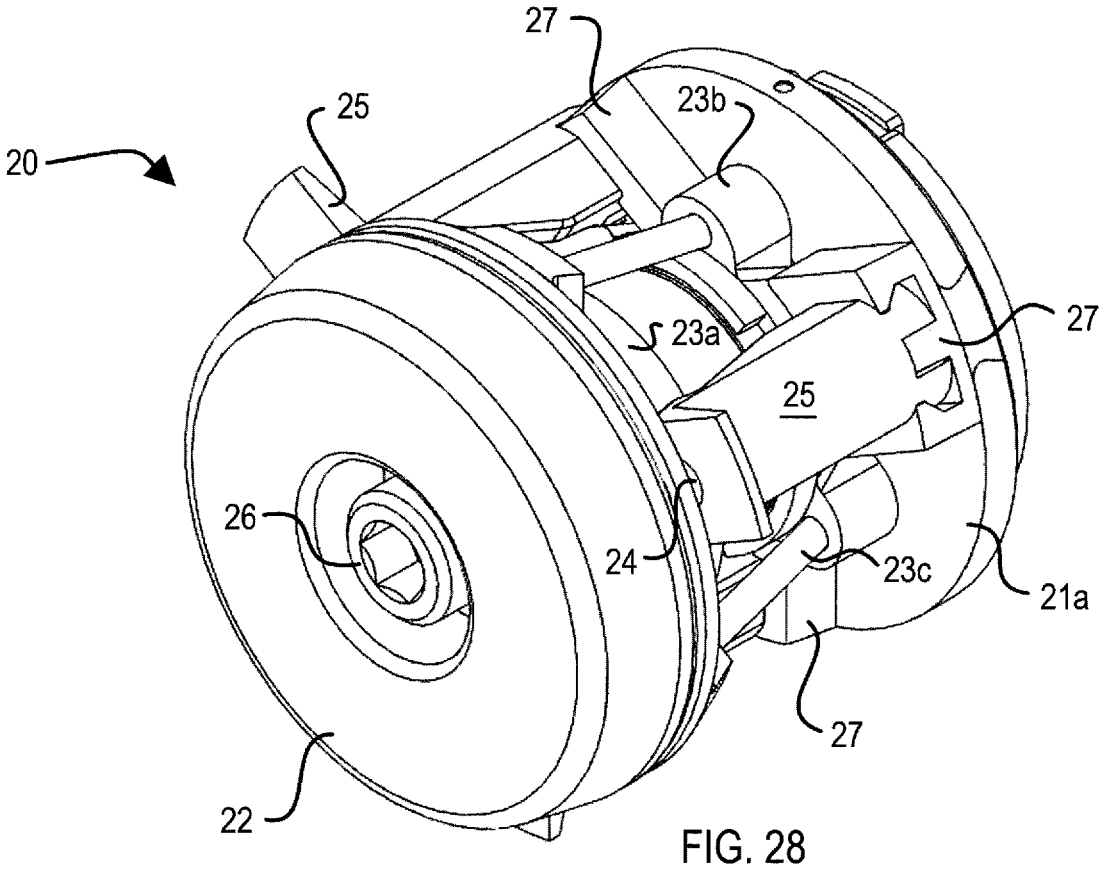
FIG. 28 is a perspective view of the fully assembled mounting subassembly of FIG. 27 in its expanded state.
Figure 29:
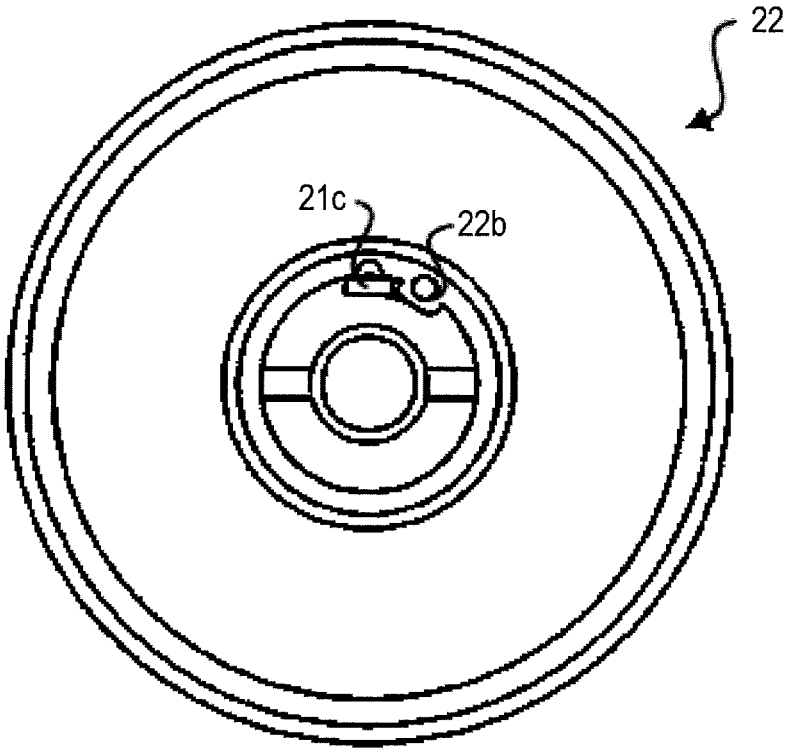
FIG. 29 is a top elevational view of the actuator and central support of the mounting subassembly of the present invention, with the actuator rotated into its locked position.
Figure 31:
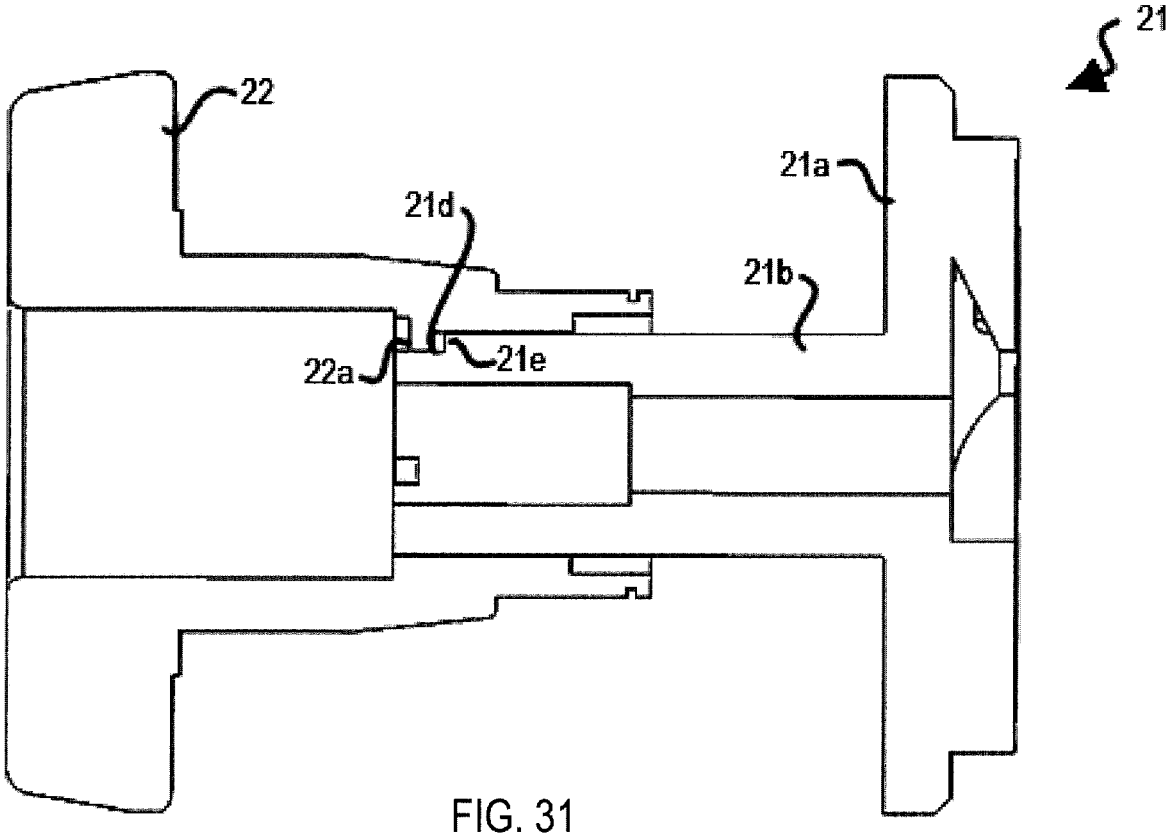
FIG. 31 is a side cross-sectional view of the actuator in the locked position of FIG. 29.

The mounting subassembly is engageable between a retracted and expanded state/position, shown in FIGS. 27-28. In the retracted state/position, the button 22 is fully biased away from the central support base plate 21*a* via the compression spring 29. In this retracted position, the button 22 is further rotatable between a locked and an unlocked position. In the locked position, the button flange 22*b* is disposed within the locking groove 21*d* of the hollow projection 21*b*, as shown in FIGS. 29 and 31. The button is therefore unable to be pushed inward when in the locked position, as the button flange 22*b* will contact the stopping wall 21*e* and prevent any further inward movement of the button 22.

Figure 30:
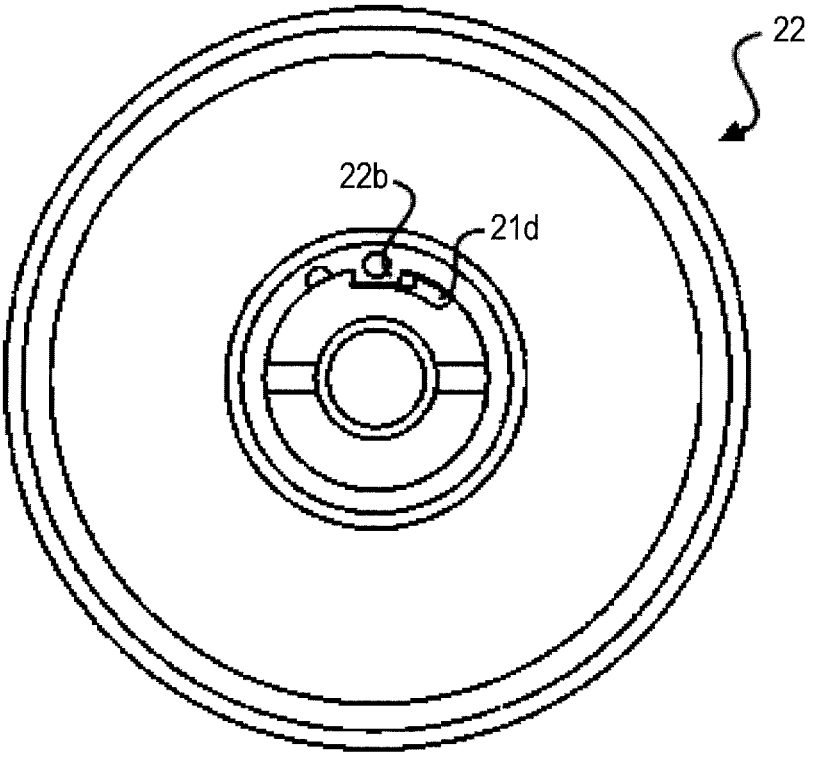
FIG. 30 is a top elevational view of the actuator and central support of the mounting subassembly of the present invention, with the actuator rotated into its unlocked position.
Figure 32:
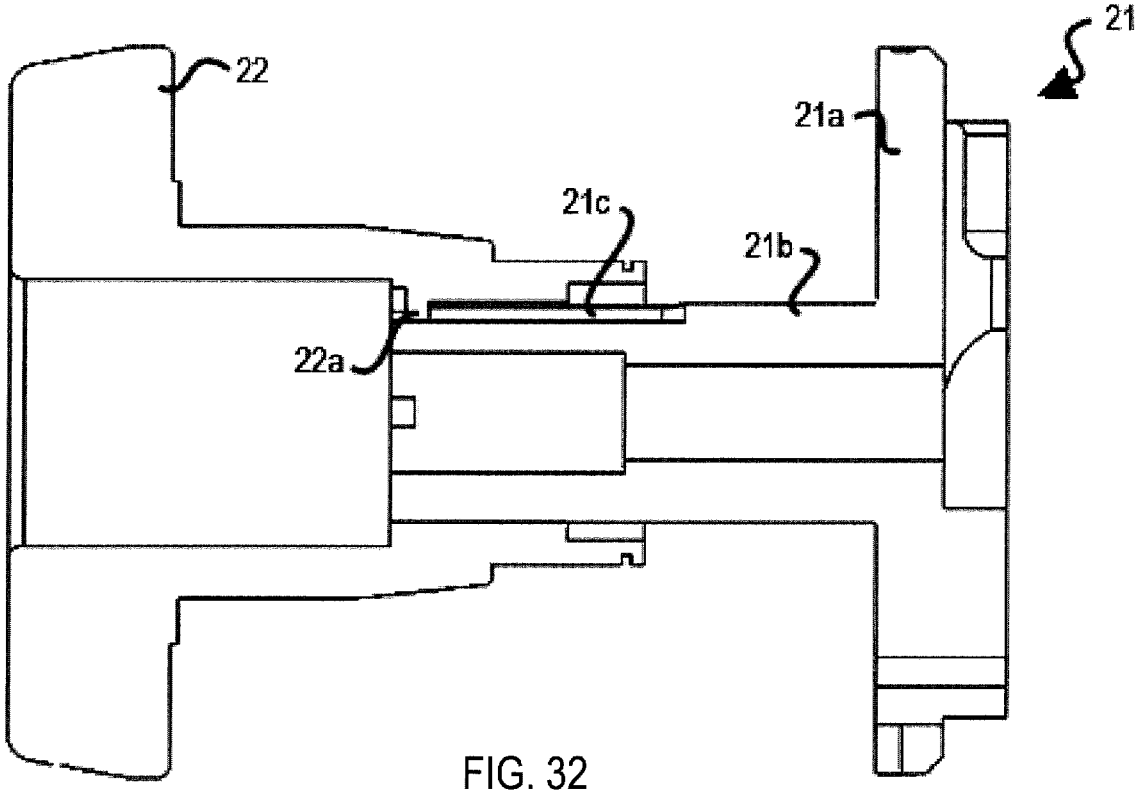
FIG. 32 is a side cross-sectional view of the actuator in the unlocked position of FIG. 30.
Figure 33:
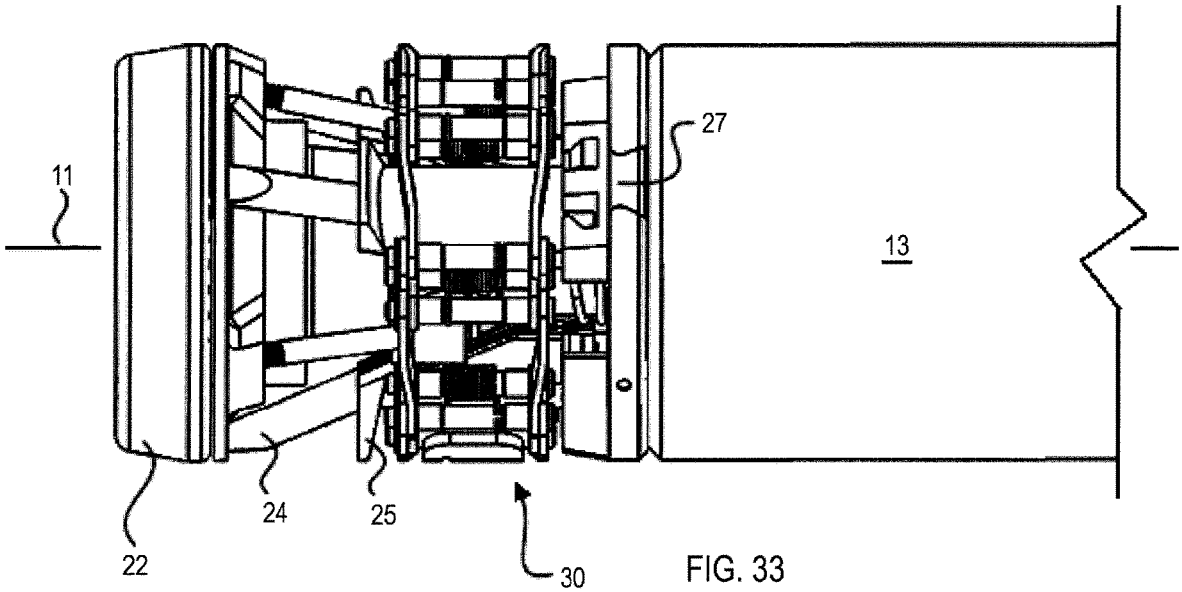
FIG. 33 is a partial side elevational view of the mounting subassembly and weight retaining mechanism of the present invention installed onto the barbell sleeve, with the mounting subassembly in the retracted state and the weight retaining mechanism collapsed.

To switch the button 22 to the unlocked position shown in FIGS. 30 and 32, the button 22 must be rotated some distance in a clockwise or counter-clockwise direction, with such rotational range being between 10°-90°. Once the button is fully rotated the required distance, the button flange 22*b* will align with the central channel 21*c* of the hollow projection 21*b* and allow for inward, axial movement of the button 22 via pushing forces.

As the button 22 is pushed inward, the pin retainers 23*a*, 23*b* and corresponding radial wedge pins 24 will conjunctively move in. The tapering disposition of the radial wedge pins 24 will result in a uniformly increasing diameter about the outer surfaces of the radial wedge pins 24 as they are driven inward with the button 22, as shown in FIGS. 27-28 and 33-34. This increase in diameter will in turn drive the radial wedges 25 outwards, as they slide perpendicularly within the slots of the corresponding dovetail inserts 27.

Figure 34:
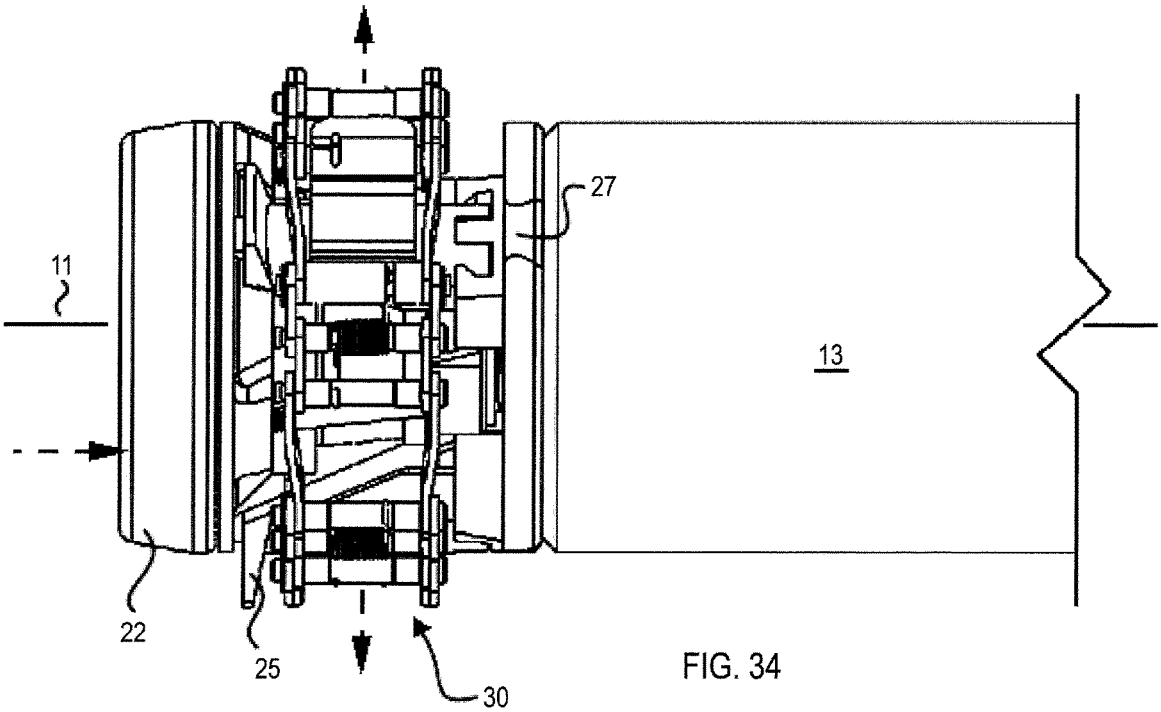
FIG. 34 is a partial side elevational view of the mounting subassembly, weight retaining mechanism, and barbell sleeve of FIG. 33, with the mounting subassembly engaged into its expanded state and the weight retaining mechanism expanded.
Figure 35:
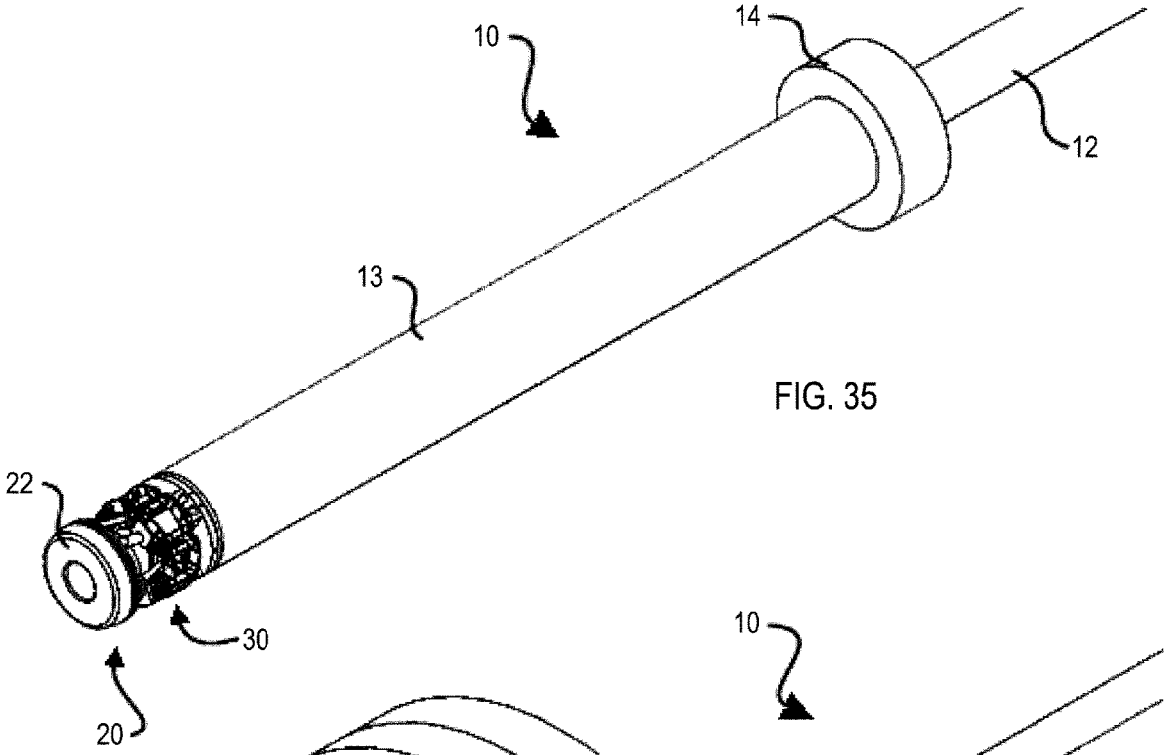
FIG. 35 is a perspective view of the mounting subassembly and weight retaining mechanism installed on the barbell sleeve, with the mounting subassembly in its retracted state and the weight retaining mechanism collapsed.
Figure 36:
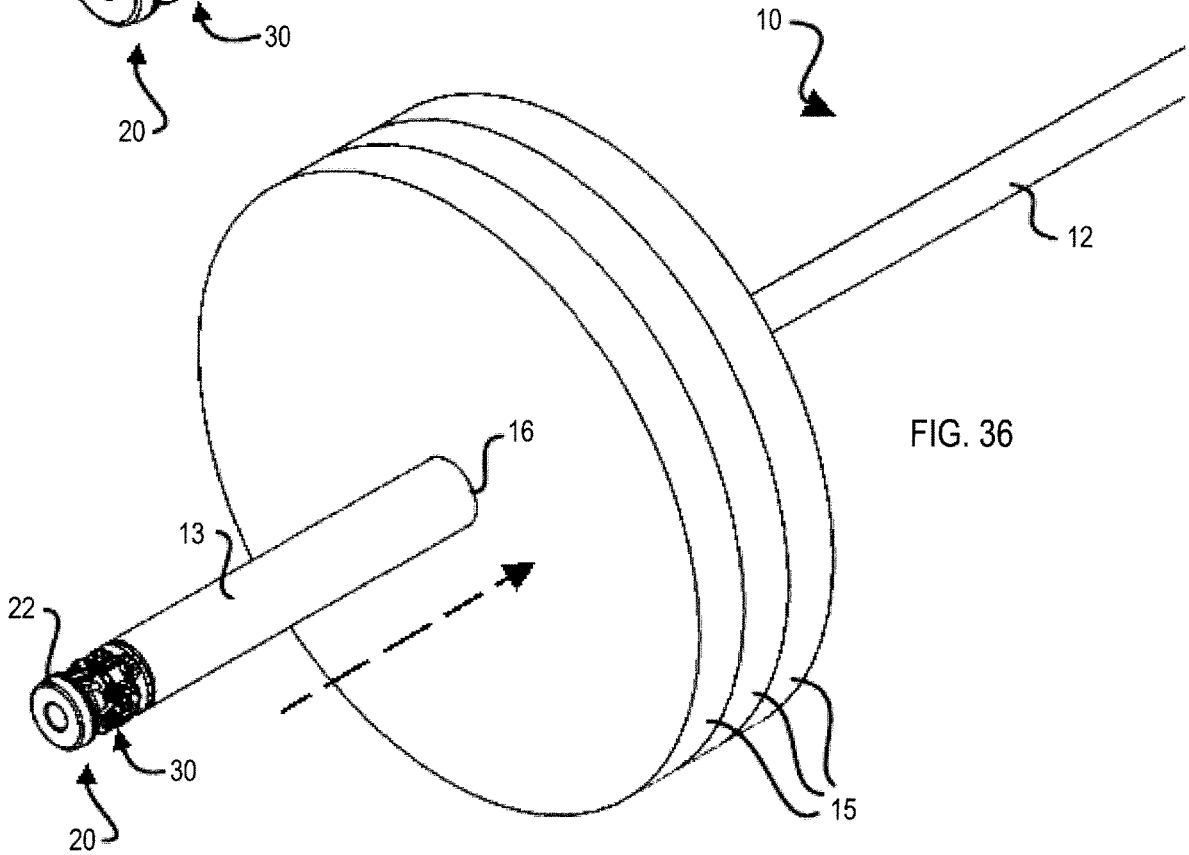
FIG. 36 is a perspective view of the mounting subassembly, weight retaining mechanism, and barbell sleeve of FIG. 35, showing the step of sliding weight plates over the mounting subassembly and weight retaining mechanism of the present invention onto the barbell sleeve.
Figure 37:
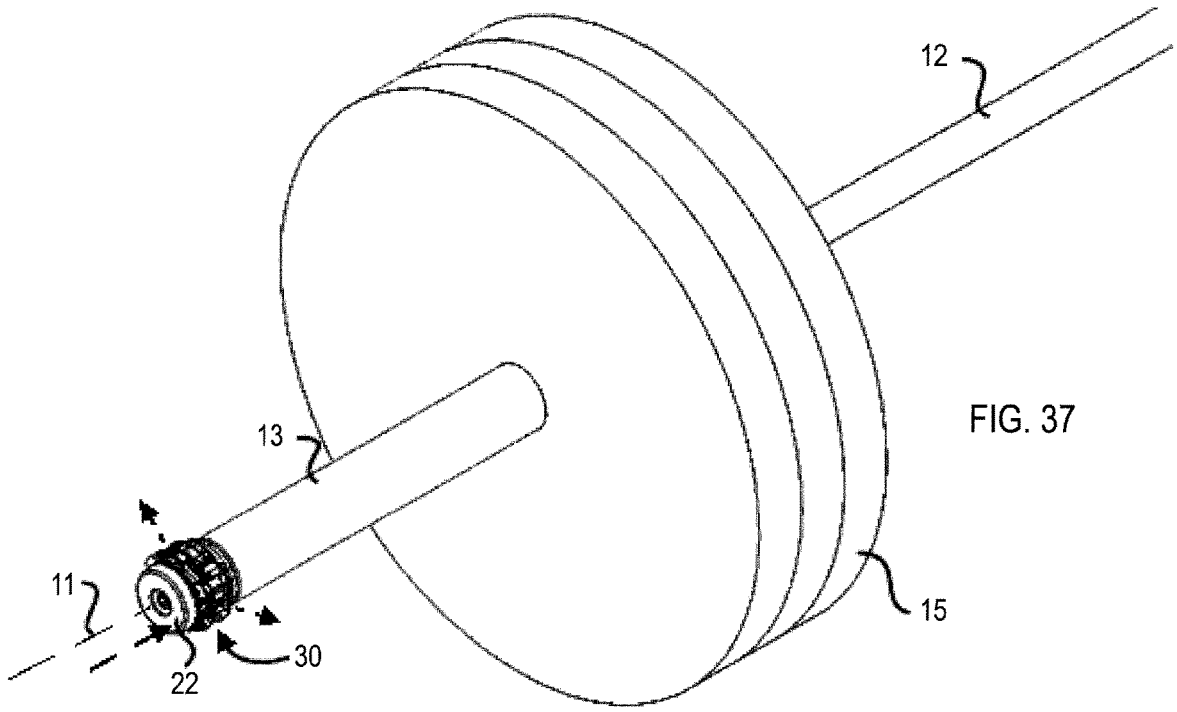
FIG. 37 is a perspective view of the mounting subassembly, weight retaining mechanism, and barbell sleeve of FIG. 35, with the mounting subassembly being engaged into its expanded state to expand the weight retaining mechanism.
Figure 38:
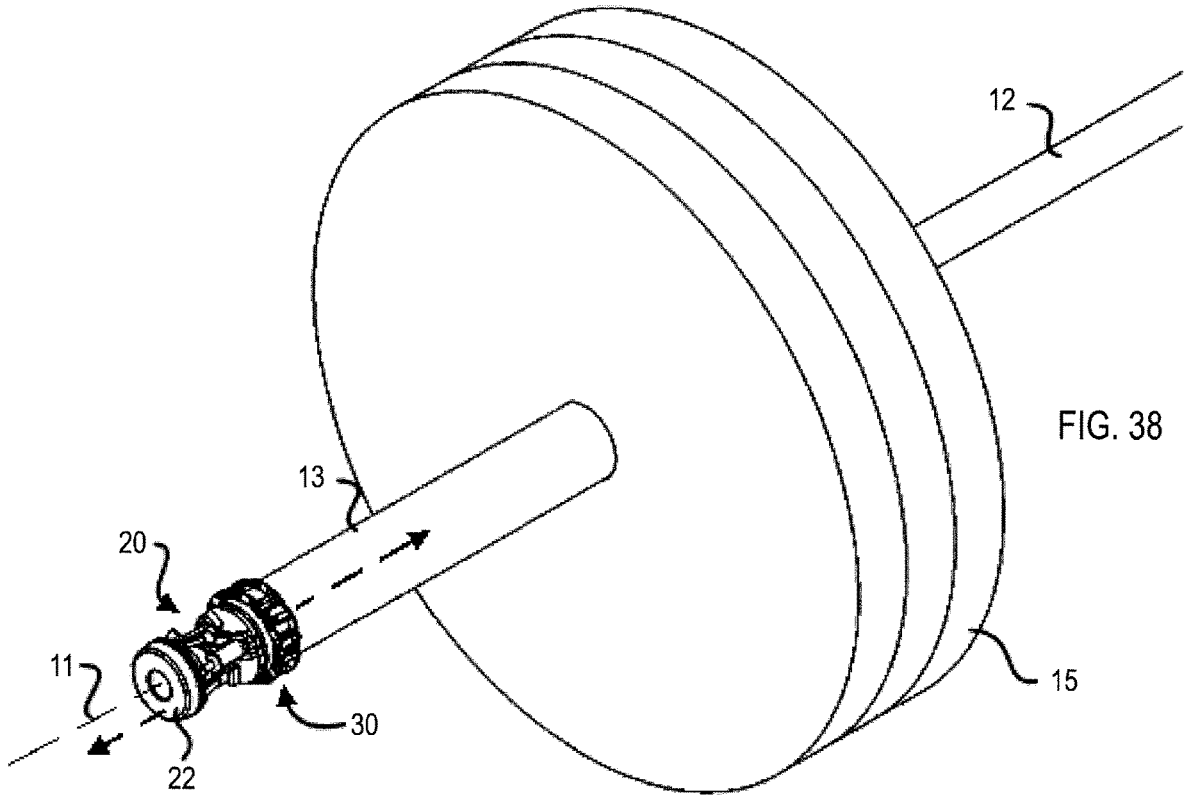
FIG. 38 is a perspective view of the mounting subassembly, weight retaining mechanism, and barbell sleeve of FIG. 35, with the expanded weight retaining mechanism being moved onto the barbell sleeve and the mounting subassembly naturally biasing back into its retracted state.
Figure 39:
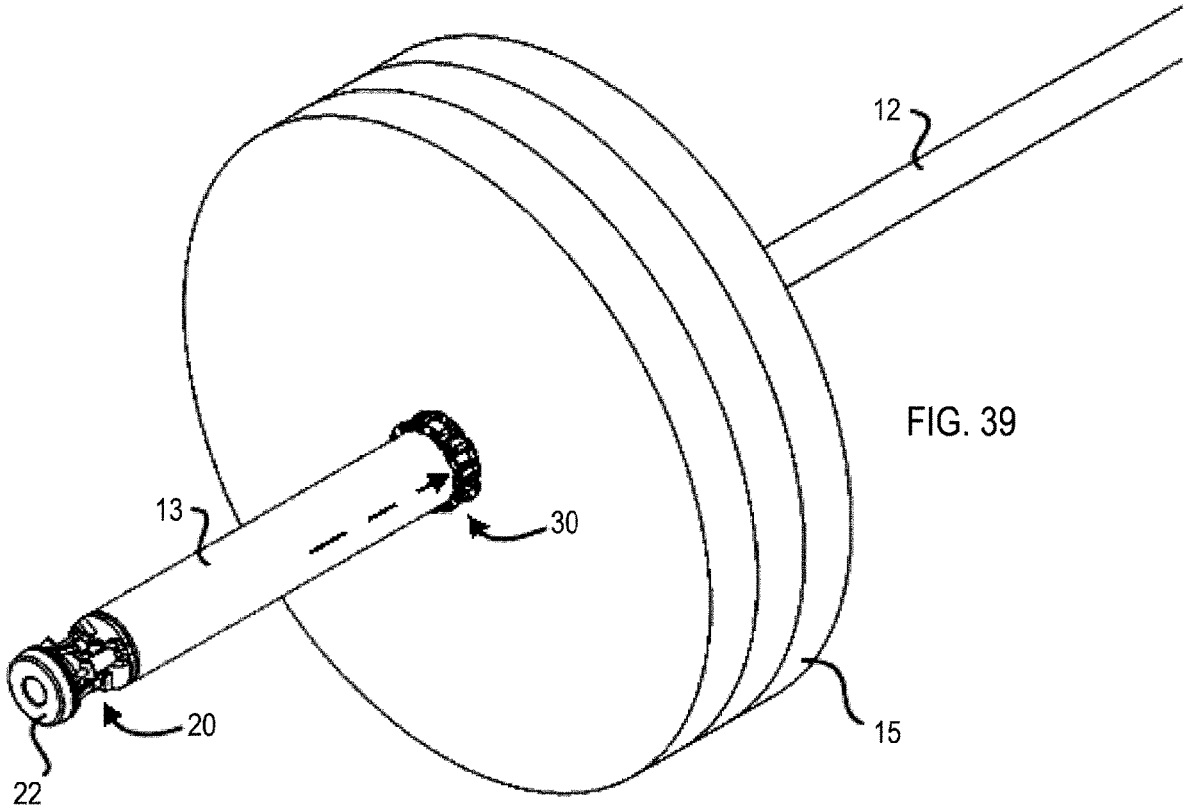
FIG. 39 is a perspective view of the mounting subassembly, weight retaining mechanism, and barbell sleeve of FIG. 35, with the weight retaining mechanism being moved up the length of the barbell sleeve until it rests against the weight plates.

Weight retaining mechanism 30 will be disposed about these radial wedges 25 in a collapsed state while the mounting subassembly 20 is in its retracted position (FIG. 33), with a diameter less than or equal to that of the barbell sleeve 13 (this allows for weight plates to slide over the mounting subassembly and weight retaining mechanism onto the sleeve 13; see FIGS. 35-36). Pushing the button 22 to translate the mounting subassembly into its expanded position will expand the radial wedge diameter as described above, which will in turn expand the diameter of the weight retaining mechanism 30 into an expanded state as shown in FIGS. 34 and 37. Once the button 22 is fully pushed in, the weight retaining mechanism 30 will have grown to a diameter large enough to allow for it to slide over the barbell sleeve 13, as shown in FIG. 38. A user may then slide the weight retaining mechanism 30 down the length of the sleeve and up against the weight plates 15 while it is still in its expanded state. See FIG. 39. In some embodiments, the weight retaining mechanism 30 will be automatically pushed up onto the barbell sleeve 13 via push spring action as the mounting subassembly is engaged into its expanded state/position, without the need for manual interaction.

Figure 40:
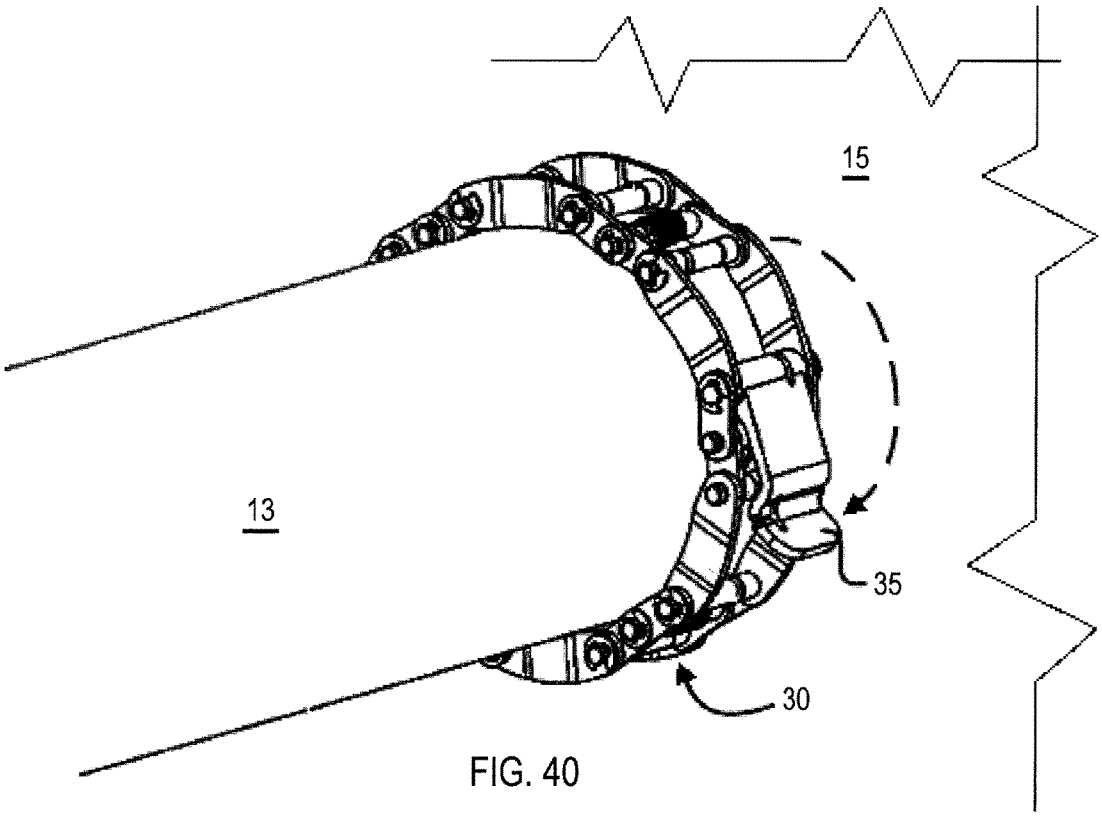
FIG. 40 is a close-up perspective view of the weight retaining mechanism against the weight plates as shown in FIG. 39, and a toggle lever of the weight retaining mechanism being engaged to tighten the weight retaining mechanism around the barbell sleeve and secure the weight retaining mechanism in place.

Once the weight retaining mechanism 30 is up against the weight plates 15, it may be engaged to tighten the diameter, raise the frictional coefficient, and secure the weight retaining mechanism 30 in place on the sleeve 13, as shown in FIG. 40. The weight plates 15 will be properly secured onto the barbell as a result.

Figure 41:
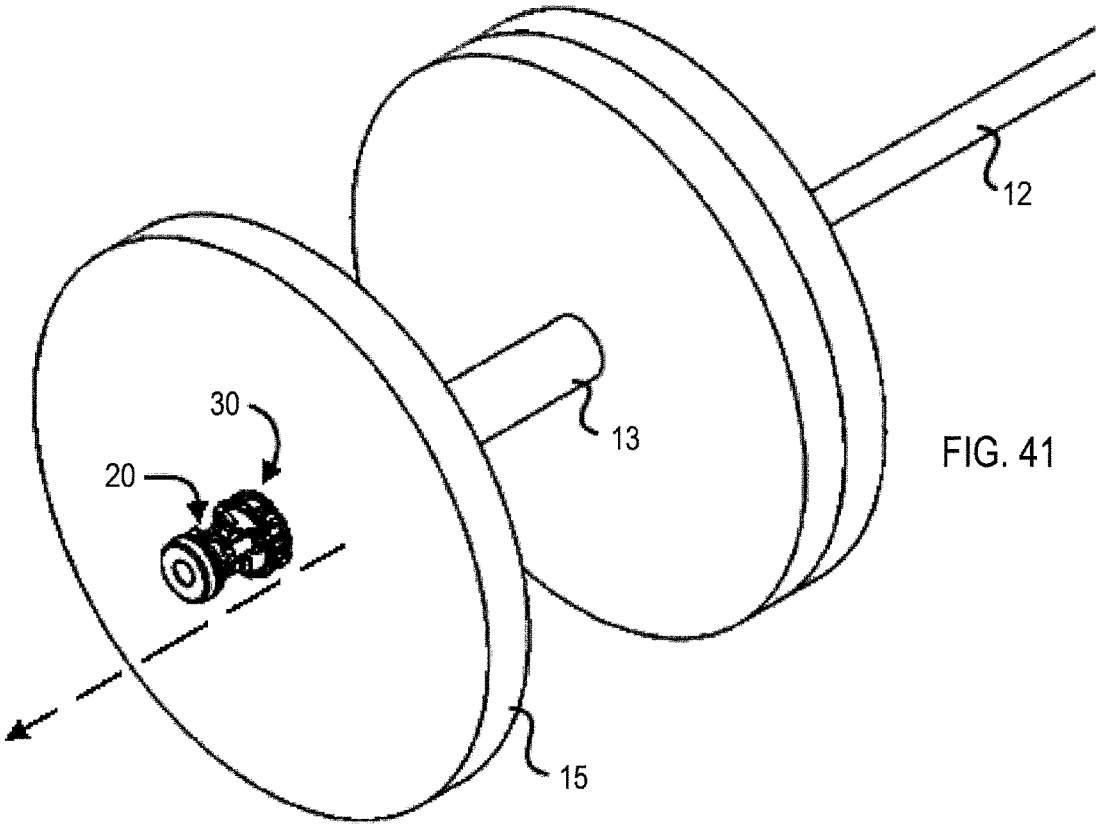
FIG. 41 is a perspective view of the mounting subassembly, weight retaining mechanism, and barbell sleeve of FIG. 35, with the weight retaining mechanism loosened via disengagement of the toggle lever, and further being moved down the length of the barbell sleeve as an adjacent weight plate is simultaneously pulled off of the barbell sleeve.
Figure 42:
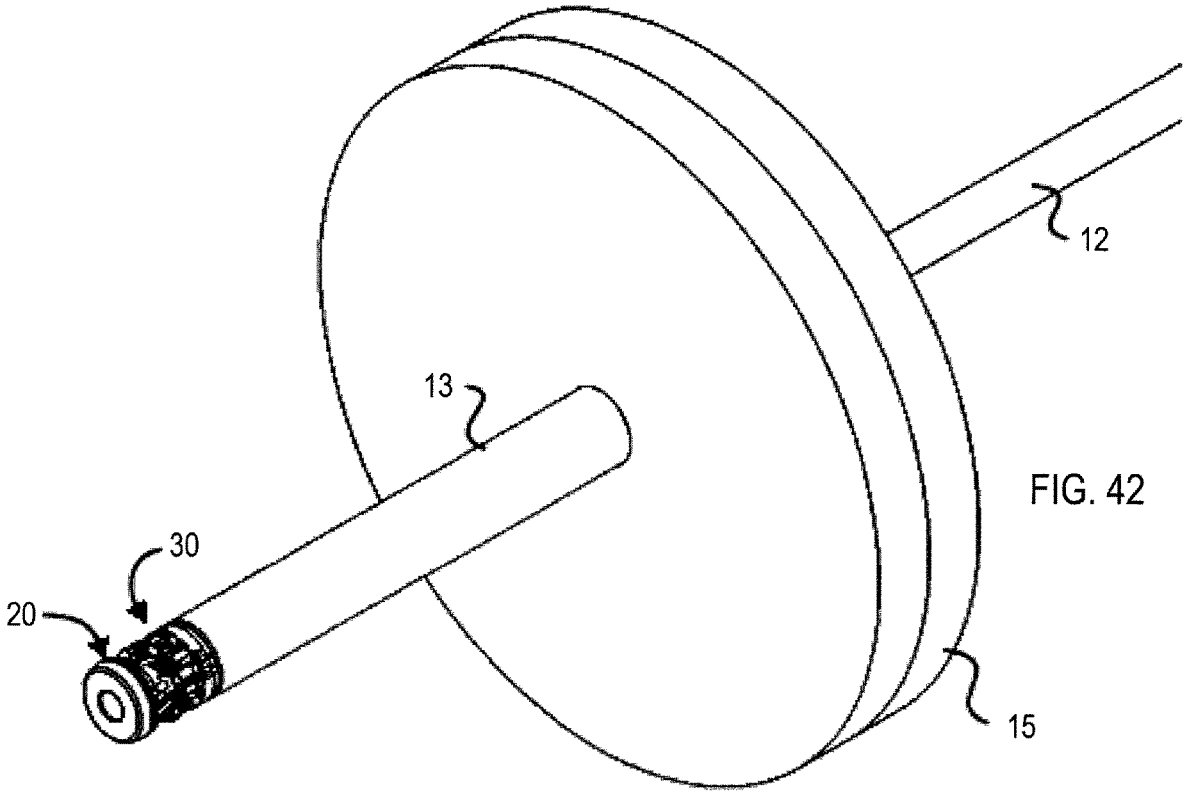
FIG. 42 is a perspective view of the mounting subassembly, weight retaining mechanism, and barbell sleeve of FIG. 35, with one of the weight plates being fully removed from the barbell sleeve, and the weight retaining mechanism being disposed around the mounting subassembly in a collapsed state to allow for further removal/addition of more weight plates from the barbell sleeve.

The weight retaining mechanism 30 may then be disengaged to loosen its diameter, lower the frictional coefficient, and allow for easy sliding back up the length of the sleeve until it finally rests on the radial wedges 25. The weight plate 15 may be used to push the weight retaining mechanism up the length of the sleeve as well, as shown in FIG. 41. The mounting subassembly 20 will be naturally biased back into its retracted position, which will allow for the weight retaining mechanism to compress back onto the mounting subassembly into a diameter small enough to allow for the weight plates 15 to be removed from the barbell sleeve 13 without interference, as shown in FIG. 42.

Figure 43:
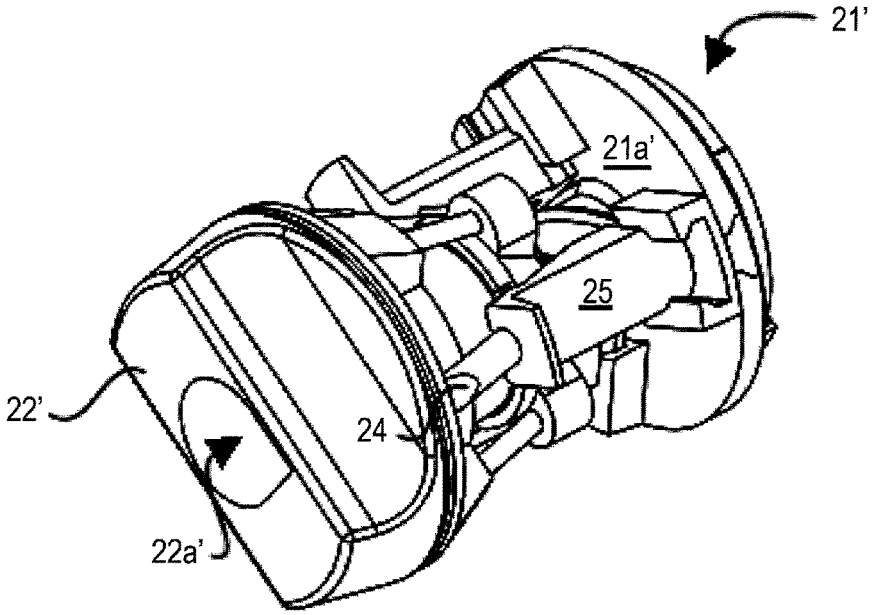
FIG. 43 is a perspective view of an alternate embodiment of a central support and actuator of the mounting subassembly of the present invention.
Figure 44:
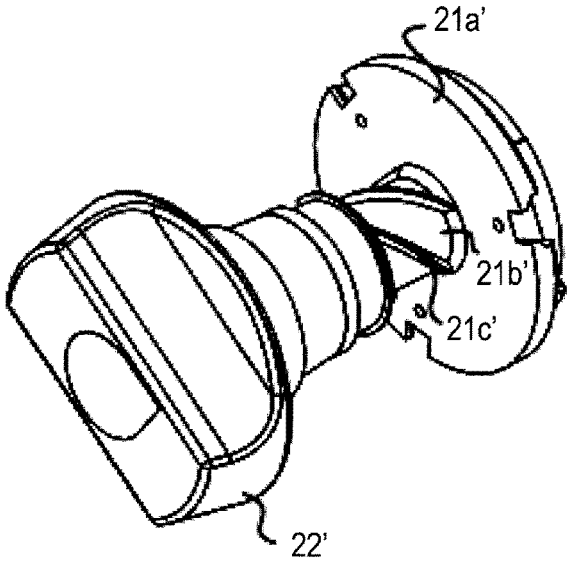
FIG. 44 is a perspective view of the threaded central support and actuator of the mounting subassembly of FIG. 43.
Figure 45:
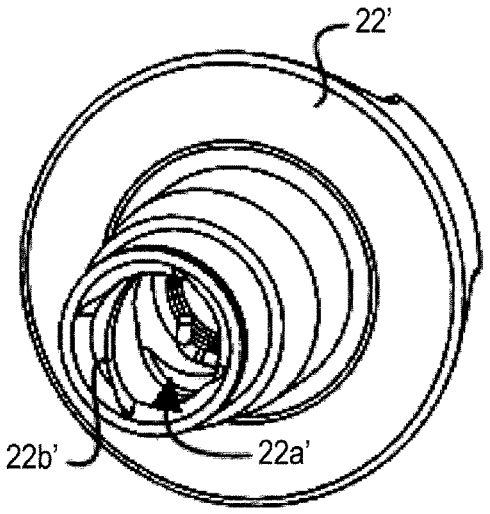
FIG. 45 is a rear perspective view of the threaded actuator of the mounting subassembly of FIG. 43.
Figure 46:
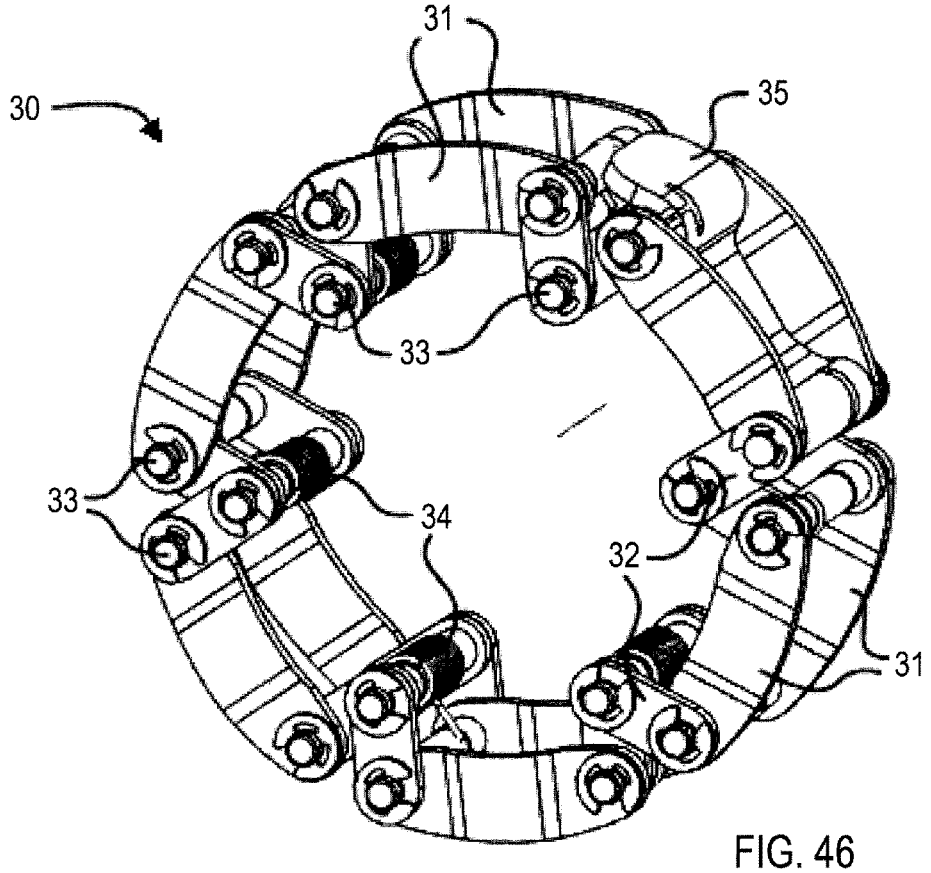
FIG. 46 is a perspective view of the weight retaining mechanism of the present invention in its collapsed state.
Figure 47:
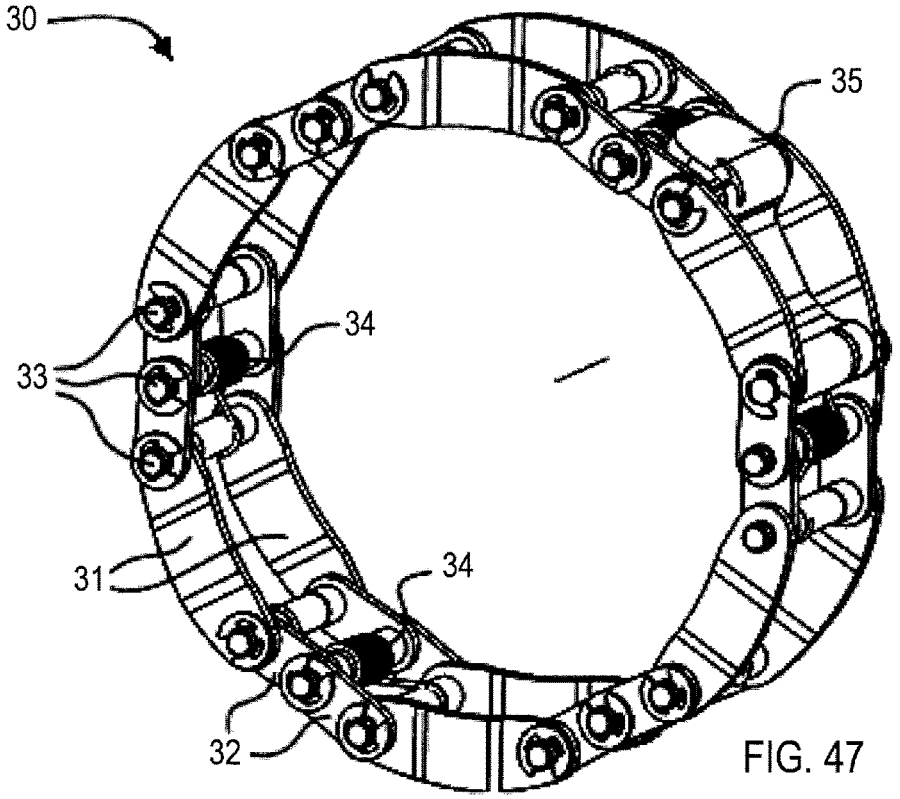
FIG. 47 is a perspective view of the weight retaining mechanism of FIG. 46 in its expanded state.
Figure 48:
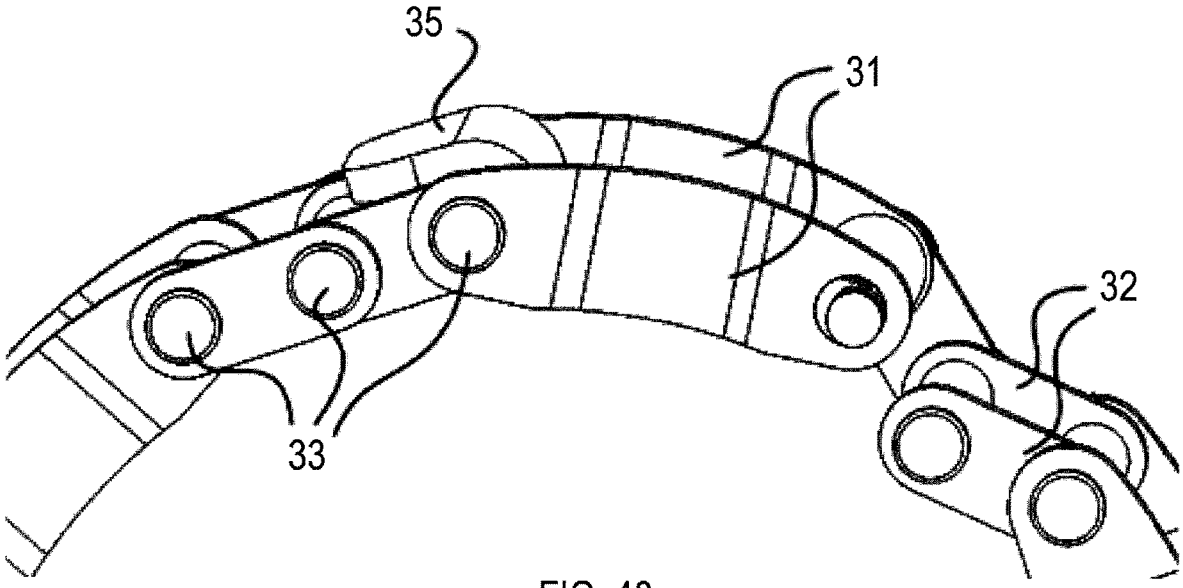
FIG. 48 is a close up view of the weight retaining mechanism of FIG. 46 with the toggle lever disengaged.
Figure 49:
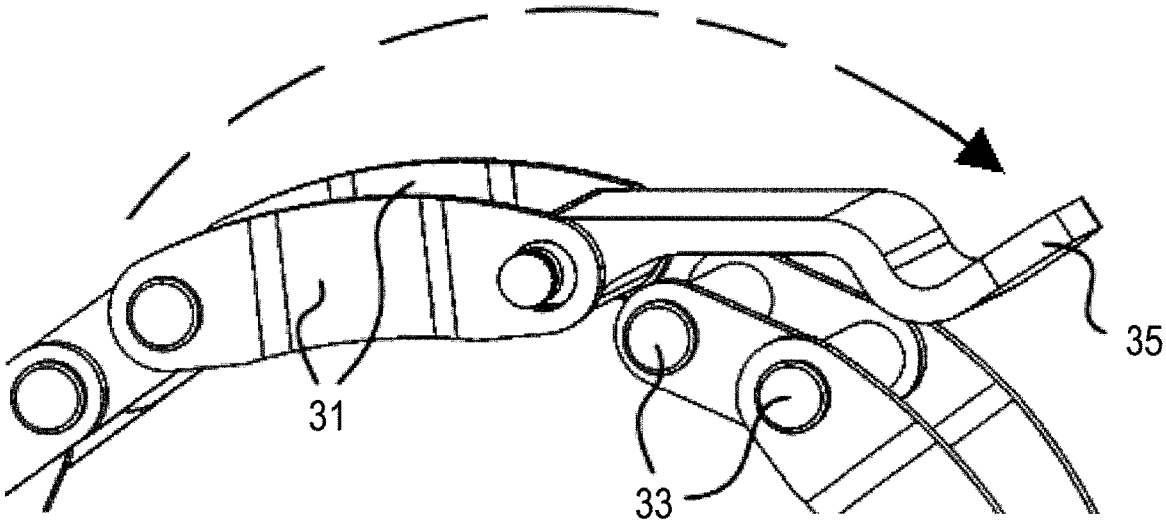
FIG. 49 is a close up view of the weight retaining mechanism of FIG. 46 showing engagement of the toggle lever to tighten the weight retaining mechanism.

The actuator or button 22 and its axial engagement with the mounting subassembly 20 may be replaced with actuator or knob 22', as shown in FIGS. 43-45. This knob 22' includes a bore 22*a*' that has a threaded interior surface 22*b*', the threads of which are to be received by a threaded body 21*c*' of a hollow projection 21*b*' that extends from a base 21*a*' of a central support 21'. The knob may be rotated clockwise/counterclockwise to encourage its axial movement and drive the radial wedges 25 inward/outward respectively. This will accomplish similar engagement of the mounting subassembly 20 to the respective expanded/retracted positions previously described.

The weight retaining mechanism 30 may be constructed into a number of different embodiments, and should not be construed as being limited to the bike chain locking mechanism 30 shown in the drawings presented herewith.

Bike Chain Locking Mechanism

The weight retaining mechanism 30 shown in FIGS. 46-49 is composed from a series of larger links 31 and smaller links 32 interlocked with each other, similar in structure to a bike chain or a roller chain. Two fully connected sets of these interlocked links 31, 32 are disposed parallel to each other in a substantially circular or elliptical form, with pins or rivets 33 extending perpendicularly between the two sets of interlocked links to hold them together. Torsion springs 34 are disposed on these pins or rivets 33 to assist in translating the weight retaining mechanism 30 between its expanded and retracted states, as described above. Rubber bands, customized flat springs, or extension springs may also be used in place of torsion springs 34. A toggle lever 35 is disposed on at least one of the pins or rivets 33 between a pair of links 31, 32, and is translatable between a locked and unlocked position. In the locked position, the weight retaining mechanism is tightened to collapse into a diameter equal to or lesser than that of the barbell sleeve. In the unlocked position, the weight retaining mechanism 30 is loosened to allow for the weight retaining mechanism to be expanded to its maximum potential diameter, such that it is at least equal to or greater than that of the barbell sleeve.

Once a user slides the bike chain weight retaining mechanism up onto the barbell sleeve and against the weight plates, they may lock the bike chain in place via the toggle lever 35 disposed on the circumference of the weight retaining mechanism. Closing the toggle lever 35 will tighten and decrease the length of the weight retaining mechanism 30, thus creating a pressure against the barbell sleeve 13 which locks the weight retaining mechanism into place on the sleeve. The weight plates 15 will now be retained in position up against the sleeve stops 14. The weight retaining mechanism can be re-opened or loosened into its unlocked position by opening the toggle lever 35, allowing the weight retaining mechanism diameter to expand so that it may easily slide back along the sleeves and onto the mounting subassembly.

Figure 50:
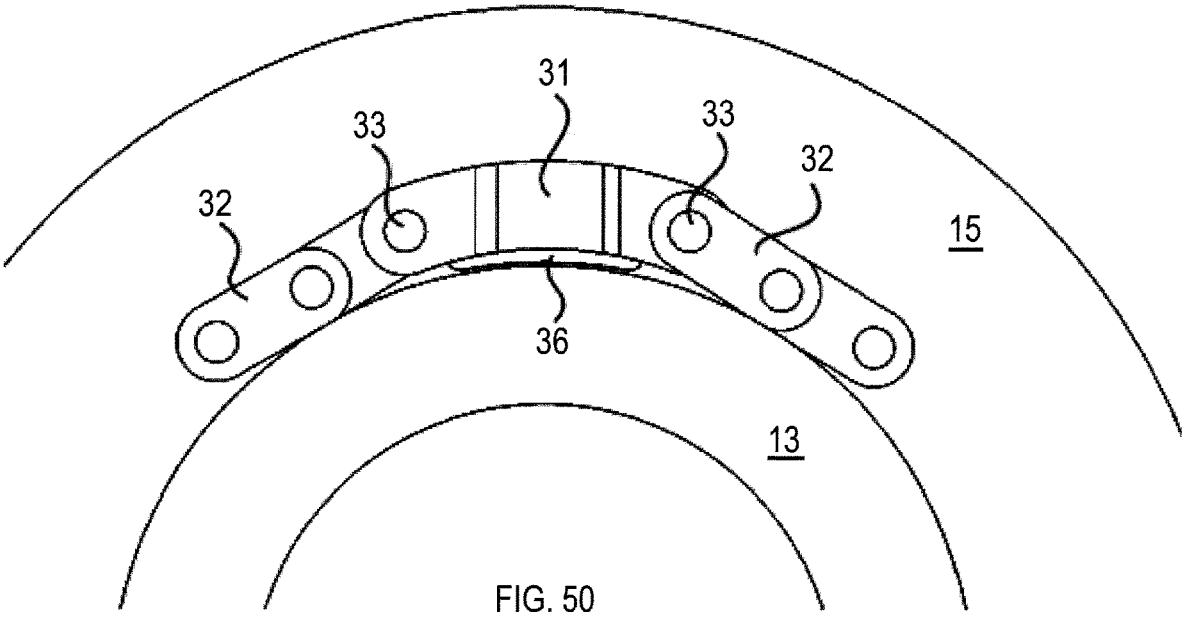
FIG. 50 is a partial view of the weight retaining mechanism of FIG. 46 disposed on a barbell sleeve, the weight retaining mechanism having a friction pad disposed between its links, and the weight retaining mechanism in a loosened state such that the friction pad slightly avoids contact with the surface of the barbell sleeve.
Figure 51:
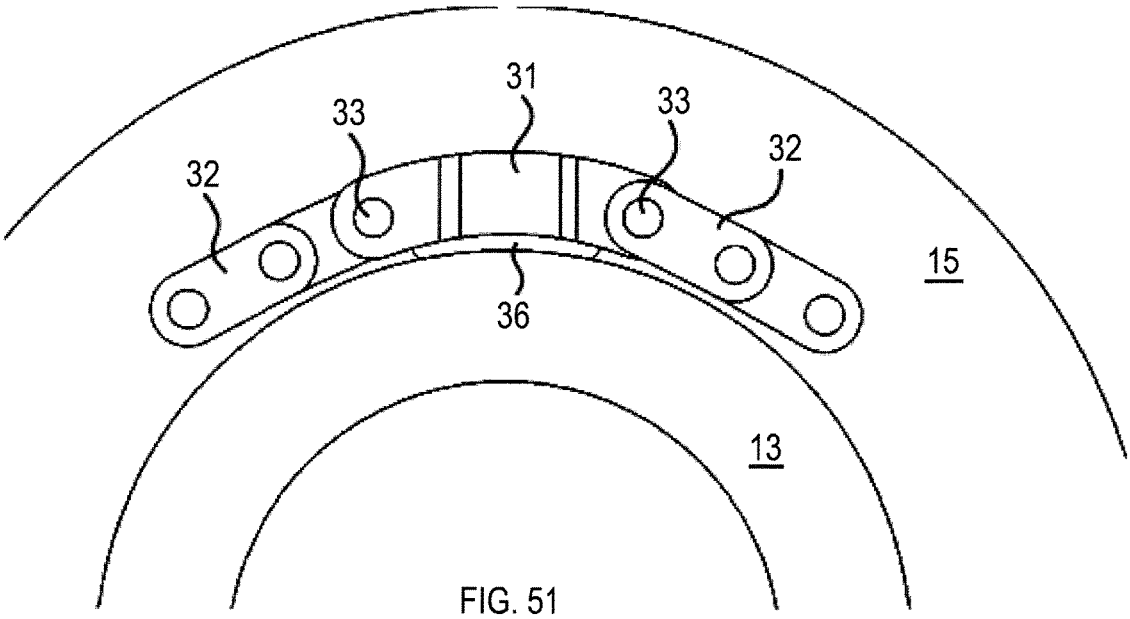
FIG. 51 is a partial view of the weight retaining mechanism and barbell sleeve of FIG. 50, with the weight retaining mechanism in a tightened state such that the friction pad contacts the surface of the barbell sleeve.

Friction pads 36 may be included on the bike chain locking mechanism embodiment to increase the frictional coefficient of the weight retaining mechanism 30. These friction pads would be disposed between the pins or rivets 33, as shown in FIGS. 50-51. The friction pads would not contact the sleeve while the weight retaining mechanism is in the unlocked state (as shown in FIG. 50), but once the weight retaining mechanism is tightened to its locked state, they will contact the sleeve and further assist in keeping the weight retaining mechanism secured in place, as shown in FIG. 51.

The outer diameters of conventional barbell sleeves 13 may have upper and lower limits (up to +/−0.030 in.). The larger links 31 are thus slightly bent inwards (i.e. into the space in the middle of the weight retaining mechanism 30 where the pins or rivets 33 are disposed) to ensure the chain can lock onto most barbell sleeves 13 regardless of their variation in diameter.

Alternate Locking Mechanisms

Other embodiments of the locking mechanism 30 may be used and interact with the mounting subassembly 20 and barbell sleeve 13 in a similar fashion as described above.

Spring Band Collet Concept

A second embodiment of the weight retaining mechanism, otherwise known as the spring band collet locking mechanism 30', may serve as a suitable replacement for the locking mechanism 30 of the present invention.

The spring band collet 30' comprises a spring band strap having collet pieces disposed about its inner circumferential wall. The spring band strap is collapsible such that the collet pieces are pushed towards the center to a collapsed state, and expandable such that the collet pieces separate and expand to a diameter large enough to allow for it to slide over the barbell sleeves 13. A lever latch disposed on the spring band strap can toggle the spring band strap and associated collet pieces into the expanded/collapsed states as described above.

Camming Concept

A third embodiment of the weight retaining mechanism, otherwise known as the segmented ring locking mechanism 30" may serve as a suitable replacement for the locking mechanism 30 of the present invention.

The segmented ring 30" includes a broken outer ring and a broken inner ring, where the outer ring overlaps with the inner ring when in the collapsed state. Once the outer ring and inner ring are pushed apart into the expanded state, an elastic membrane biases the outer ring and inner ring back towards its collapsed state. This allows for the segmented ring 30" to secure itself onto the barbell sleeve once it is installed.

Wedge Ring Concept

A fourth embodiment of the weight retaining mechanism, otherwise known as the wedge ring locking mechanism 30'" may serve as a suitable replacement for the locking mechanism 30 of the present invention.

The wedge ring 30'" comprises a segmented ring that is translatable from a collapsed state to an expanded state. Each segment of the wedge ring is shaped (i.e. angled) to ride over and conform to the barbell sleeve 13. The segments work in a manner similar to a door stop, in that they squeeze radially about the sleeve to prevent axial movement.

Thus, the present invention provides one or more of the following advantages: 1) a barbell weight retaining mechanism comprising an assembly that can be easily attached to the sleeves or handlebars of currently-existing barbells without necessitating any modification of said barbell; 2) a weight retaining mechanism that can be easily stored on or within the edge of barbell sleeves or handlebars in a manner that is cost effective; 3) a weight retaining mechanism that mitigates the risk of fitness-related injuries.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An assembly for securing a weight plate to a barbell, comprising:

the barbell having a length, a handle bar having an edge and a first diameter, and at least one sleeve having an edge and a second diameter, wherein the handle bar first diameter is smaller than the at least one sleeve second diameter;

a mounting subassembly attached to the edge of the at least one sleeve or handlebar of the barbell, the mounting subassembly comprising an actuator for translating the mounting subassembly from a retracted state to an expanded state; and a locking subassembly expandable to an expanded state having a diameter greater than that of the at least one sleeve second diameter, and retractable to a collapsed state having a diameter lesser than that of the at least one sleeve second diameter, the locking subassembly disposed about the mounting subassembly when in the collapsed state;

wherein engagement of the mounting subassembly actuator translates the mounting subassembly to its expanded state and simultaneously expands the locking subassembly disposed thereon to its expanded state, which allows the locking subassembly to slide over the at least one sleeve along its length to secure the weight plate to the barbell.

2. The assembly of claim 1 wherein the barbell at least one sleeve edge further includes a cavity, and the mounting subassembly includes a friction mount for insertion into the cavity of the at least one sleeve.

3. The assembly of claim 1 wherein the barbell at least one sleeve edge further includes a cavity and a snap ring disposed therein, and the mounting subassembly includes a snap ring mount for insertion into the cavity of the at least one sleeve.

4. The assembly of claim 3 wherein the snap ring further includes a slot, and the snap ring mount further includes a ram having a lip for reception by the snap ring slot once the snap ring mount is inserted into the cavity containing the snap ring.

5. The assembly of claim 1 wherein the at least one sleeve floats on the handle bar, and the mounting subassembly includes an end cap mount having a hollow cavity for receiving the edge of the handle bar.

6. The assembly of claim 5 wherein the end cap mount is securable up against the at least one sleeve and onto the handle bar via a pin that is received by through holes on both a body of the end cap mount and the edge of the handle bar.

7. The assembly of claim 1 wherein the mounting subassembly further includes:

a central support having a base plate and a hollow projection; and pin retainers radially disposed around the actuator, the pin retainers having radial wedge pins disposed therebetween, the radial wedge pins further being received by radial wedges.

8. The assembly of claim 7 wherein the hollow projection further includes a central channel disposed thereon, and the actuator is a button having a button flange for reception by the hollow projection central channel.

9. The assembly of claim 7 wherein the hollow projection includes a threaded body, and the actuator is a knob having a threaded interior surface for reception by the threaded body of the hollow projection.

10. A method for securing at least one weight plate to a barbell, comprising:

providing at least one weight plate;

providing the barbell having a length, a handle bar having an edge and a first diameter, and at least one sleeve having an edge and a second diameter, wherein the handle bar first diameter is smaller than the at least one sleeve second diameter;

providing a mounting subassembly attachable to the edge of the at least one sleeve or handlebar of the barbell, the mounting subassembly comprising an actuator for translating the mounting subassembly to a retracted state and an expanded state;

providing a locking subassembly translatable to an expanded state where the locking subassembly has a diameter greater than that of the at least one sleeve second diameter, and to a collapsed state where the locking subassembly has a diameter lesser than that of the at least one sleeve second diameter, the locking subassembly being disposed about the mounting sleeve subassembly;

attaching the mounting subassembly to the edge of the at least one sleeve of the barbell;

sliding the at least one weight plate over both the mounting subassembly and locking subassembly onto the at least one sleeve;

engaging the actuator to translate the mounting subassembly from the retracted state to the expanded state;

translating the locking subassembly to its expanded state;

sliding the locking subassembly over the at least one sleeve;

pushing the locking subassembly up against the at least one weight plate; and securing the at least one weight plate to the at least one sleeve via the locking subassembly.

11. The method of claim 10 further including:

providing a cavity on the at least one sleeve edge;

providing a friction mount disposed on the mounting subassembly, the friction mount having an elongated body and a ram, the ram being engageable by a fastener disposed in the friction mount elongated body;

inserting the elongated body of the friction mount into the cavity of the at least one sleeve edge;

engaging the fastener to interact with the ram and drive the ram out from the elongated body; and clamping the mounting subassembly into the at least one sleeve cavity.

12. The method of claim 10 further including:

providing a cavity on the at least one sleeve edge, the cavity having a snap ring with a snap ring groove disposed therein;

providing a snap ring mount disposed on the mounting subassembly, the snap ring mount having an elongated body and a ram having a lip, the ram being engageable by a fastener disposed in the snap ring mount elongated body;

inserting the elongated body of the snap ring mount into the cavity of the at least one sleeve edge;

engaging the fastener to interact with the ram and drive the ram out from the elongated body;

catching the lip of the ram onto the snap ring groove within the cavity; and locking the mounting subassembly into the at least one sleeve cavity.

13. The method of claim 10 further including:

providing the at least one sleeve floating on the handle bar, and the at least one sleeve is secured to the handle bar via an end cap which is disposed on the edge of the handle bar;

providing a through hole bored into the edge of the handle bar;

providing an end cap mount disposed on the mounting subassembly, the end cap mount having a body with a hollow cavity for receiving the edge of the handle bar, and a through hole bored through the end cap mount body;

providing a pin sized to fit into the through hole of the end cap mount body;

removing the end cap disposed on the handle bar;

placing the body of the end cap mount over the edge of the handle bar, such that the hollow cavity of the end cap mount body receives the edge of the handle bar, and the body through hole aligns with the through hole of the handle bar;

pushing the pin into the aligned through holes of the end cap mount body and the handle bar edge; and securing the mounting subassembly to the at least one sleeve.

14. The method of claim 10 further including:

providing a central support of the mounting subassembly, the central support having a base plate and a hollow projection; and providing pin retainers radially disposed around the actuator, the pin retainers having radial wedge pins disposed therebetween, the radial wedge pins further being received by radial wedges upon which the locking subassembly is disposed thereon;

wherein the step of engaging the actuator to translate the mounting subassembly from the retracted state to the expanded state further includes:

moving the actuator, pin retainers, and radial wedge pins axially down the length of the central support hollow projection; and pushing the radial wedges outward.

15. The method of claim 14 further providing a central channel disposed on the central support hollow projection, wherein the actuator is a button comprising a button bore and a button flange disposed within the button bore, and the step of engaging the actuator includes pushing the button axially inward such that the button flange travels down the length of the central channel.

16. The method of claim 15 further including:

providing a locking groove, and a stopping wall disposed on the central support hollow projection adjacent to the central channel, the button flange sized to fit in the locking groove and move from the locking groove to the central channel;

wherein when the button flange is disposed in the locking groove, the step of pushing the button axially inward is prevented via the button flange contacting the stopping wall.

17. The method of claim 16 wherein the button is translatable between a locked state where the button flange is disposed in the locking groove, and an unlocked state where the button flange is disposed in the central channel.

18. The method of claim 17 further including:

providing the button in the locked state; and rotating the button into the unlocked state such that the button flange moves from the locking groove to the central channel, prior to the step of pushing the button axially inward.

19. The method of claim 14 wherein the actuator is a knob with a threaded interior surface, the central support hollow projection includes a threaded body, and the step of engaging the actuator includes rotating the knob to move the knob axially down the length of the central support hollow projection.

20. An assembly for securing a weight plate to a barbell, comprising:

a mounting subassembly attached to an edge of at least one sleeve or handlebar of the barbell, the mounting subassembly comprising an actuator for translating the mounting subassembly from a retracted state to an expanded state; and a locking subassembly expandable to a diameter greater than a diameter of the at least one sleeve of the barbell, and retractable, the locking subassembly capable of being disposed about the mounting subassembly, the locking subassembly further comprising a toggle lever;

wherein the locking subassembly will be automatically pushed up onto the at least one sleeve of the barbell via a push spring action as the mounting subassembly actuator is engaged to translate the mounting subassembly to the expanded state.

21. The assembly of claim 20 wherein the mounting subassembly further includes:

a central support having a base plate and a hollow projection; and pin retainers radially disposed around the actuator, the pin retainers having radial wedge pins disposed therebetween, the radial wedge pins further being received by radial wedges.

22. The assembly of claim 21 wherein the hollow projection further includes a central channel disposed thereon, and the actuator is a button having a button flange for reception by the hollow projection channel.

23. The assembly of claim 22 wherein the hollow projection further includes a locking groove disposed adjacent the central channel, and the button is rotatable such that the button flange may travel between the central channel and locking groove.

24. The assembly of claim 21 wherein the hollow projection further includes a threaded body, and the actuator is a knob having a threaded interior surface for reception by the threaded body of the hollow projection.

25. The assembly of claim 21 wherein the radial wedge pins disposed between the pin retainers are slightly tapered inward.

26. The assembly of claim 20 wherein the locking subassembly further includes a series of larger links and smaller links interlocked with each other, and the larger links are slightly bent inwards.

27. The assembly of claim 20 wherein the locking subassembly further includes a friction pad.

28. The assembly of claim 20 wherein the toggle lever can be closed to tighten the locking subassembly, and can be opened to loosen the locking subassembly.

* * * * *